US010612324B2

(12) United States Patent
Jordan et al.

(10) Patent No.: US 10,612,324 B2
(45) Date of Patent: Apr. 7, 2020

(54) WELLSITE TOOL GUIDE ASSEMBLY AND METHOD OF USING SAME

(71) Applicant: National Oilwell Varco, L.P., Houston, TX (US)

(72) Inventors: Michael Bradford Jordan, Kingwood, TX (US); Marcus Joseph Doran, Conroe, TX (US); Richard Michael Ward, Conroe, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 199 days.

(21) Appl. No.: 15/740,406

(22) PCT Filed: Jul. 22, 2016

(86) PCT No.: PCT/US2016/043689
§ 371 (c)(1),
(2) Date: Dec. 28, 2017

(87) PCT Pub. No.: WO2017/019547
PCT Pub. Date: Feb. 2, 2017

(65) Prior Publication Data

US 2018/0313177 A1 Nov. 1, 2018

Related U.S. Application Data

(60) Provisional application No. 62/196,817, filed on Jul. 24, 2015.

(51) Int. Cl.
*E21B 19/24* (2006.01)
*E21B 33/06* (2006.01)

(52) U.S. Cl.
CPC ..... *E21B 19/24* (2013.01); *E21B 33/062* (2013.01)

(58) Field of Classification Search
CPC ..... E21B 19/06; E21B 19/10; E21B 19/24; E21B 33/062; E21B 33/061
See application file for complete search history.

(56) References Cited

U.S. PATENT DOCUMENTS 1,839,394 A * 1/1932 Inge ..... E21B 33/06 251/1.1
3,194,611 A * 7/1965 Mahony ..... E21B 19/24 384/24

(Continued)

FOREIGN PATENT DOCUMENTS

WO 2015/009574 A1 1/2015

OTHER PUBLICATIONS

European Search Report dated Feb. 8, 2019, for European Application No. 16831152.0 (8 p.).

(Continued)

*Primary Examiner* — Jennifer H Gay
(74) *Attorney, Agent, or Firm* — Conley Rose, P.C.

(57) ABSTRACT

A guide assembly for a downhole tool and related method is disclosed. The guide assembly comprises a guide housing, flappers, and a driver. The guide housing has a passage to receive the downhole tool therethrough. The flappers are movably positionable about the passage to selectively reduce an inlet thereto. The driver comprises a translator rotationally coupled to the flappers via the rods and an actuator to rotate the translator. The flappers are rotatable between the closed and the open position by the driver whereby passage of the downhole tool into the passage is selectively permitted. The translator may be a cam, gear, or rotary driver. The actuator may axially or rotationally drive the translator.

23 Claims, 24 Drawing Sheets

(56) References Cited

U.S. PATENT DOCUMENTS 3,235,224 A 2/1966 Grove
3,495,864 A * 2/1970 Jones ..... E21B 19/06 294/90
3,944,300 A * 3/1976 Learmont ..... E21B 19/24 384/29
4,076,337 A * 2/1978 Childress ..... E21B 19/24 173/164
4,199,847 A * 4/1980 Owens ..... E21B 19/004 188/67
4,215,749 A 8/1980 Dare et al.
4,505,614 A * 3/1985 Anschutz ..... E21B 17/1007 175/220
4,671,312 A 6/1987 Bruton
4,715,456 A 12/1987 Poe, Jr. et al.
4,997,162 A 3/1991 Baker et al.
5,116,017 A * 5/1992 Granger ..... E21B 33/06 251/1.2
5,878,812 A * 3/1999 Heinonen ..... E21B 19/24 166/85.4
6,615,921 B2 * 9/2003 Whitelaw ..... E21B 12/04 166/349
7,779,918 B2 * 8/2010 Cowie ..... E21B 33/063 166/373
7,975,761 B2 7/2011 Berckenhoff et al.
8,353,338 B2 1/2013 Edwards
8,608,216 B2 * 12/2013 Lunde ..... E21B 19/06 294/90
9,074,450 B2 * 7/2015 Weir ..... E21B 33/06
9,388,657 B2 * 7/2016 Nelson ..... E21B 33/06
2002/0148616 A1 10/2002 Whitelaw et al.
2004/0200622 A1 * 10/2004 Jennings ..... E21B 17/1007 166/379
2008/0257557 A1 * 10/2008 Cowie ..... E21B 33/063 166/373
2010/0319906 A1 12/2010 Van Winkle
2011/0146969 A1 6/2011 Lutzhoeft
2012/0073815 A1 3/2012 Springett et al.
2012/0168227 A1 * 7/2012 Littlely ..... E21B 19/24 175/57
2012/0200101 A1 * 8/2012 Lunde ..... E21B 19/06 294/102.2
2013/0199802 A1 * 8/2013 Weir ..... E21B 33/06 166/387
2013/0220637 A1 * 8/2013 Fabela ..... E21B 19/10 166/382
2014/0169887 A1 * 6/2014 Garcia ..... E21B 19/004 405/224.4
2014/0264099 A1 9/2014 Melancon et al.
2016/0186510 A1 * 6/2016 Vestersjo ..... E21B 19/24 166/250.01
2017/0044855 A1 * 2/2017 Sipos ..... E21B 19/24
2018/0313177 A1 * 11/2018 Jordan ..... E21B 33/062
2019/0277100 A1 * 9/2019 Thiemann ..... E21B 19/24

OTHER PUBLICATIONS

PCT/US2016/043689 International Search Report and Written Opinion dated Oct. 21, 2016.
ALCO Handling Tools—Elevators (ALCO) Feb. 4, 2015 (http://alcoinc.ca/Products/Oil%20Field/HandlingTools/Elevator/Elevator.htm) (1 p.).

* cited by examiner

WELLSITE TOOL GUIDE ASSEMBLY AND METHOD OF USING SAME

CROSS-REFERENCE TO RELATED APPLICATIONS

The application is a 35 U.S.C. § 371 national stage application of PCT/US2016/043689 filed Jul. 22, 2016, and entitled "Wellsite Tool Guide Assembly and Method of Using Same," which claims the benefit of U.S. Provisional Application No. 62/196,817, filed on Jul. 24, 2015, both of which are hereby incorporated herein by reference in their entireties for all purposes.

BACKGROUND

The disclosure relates generally to wellsite techniques. More specifically, the disclosure relates to techniques for deploying tools into a wellbore.

Oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Downhole pipes may be positioned in the wellbore to enable the passage of subsurface fluids to the surface.

Various devices may be used to prevent leakage of fluids about the wellsite. Equipment, such as blowout preventers (BOPs), may be positioned about the wellbore to form a seal about a tubing therein to prevent leakage of fluid as it is brought to the surface. BOPs may have rams, such as pipe rams or shear rams, that may be activated to seal and/or sever a tubing in a wellbore. Some examples of BOPs are provided in U.S. Patent/Application Nos. 2014/0264099, 2010/0319906, 3235224, 4215749, 4671312, 4997162, 7975761, and 8353338, the entire contents of which are hereby incorporated by reference herein.

As the downhole tools are deployed into the wellbore, they may pass through an opening in the BOP. The downhole tools may be deployed by various tubing, such as a wireline, drill pipe, tool joint, coiled tubing, cable, and/or other tubular member. During such deploying, problems may occur which may interrupt operations at the wellsite. For example, the downhole tools and/or the tubulars used to deploy them may become tangled, buckled, misaligned, stuck, and/or mis-deployed into the wellbore. The present disclosure seeks to address such issues.

SUMMARY

The disclosure relates to a guide assembly for a downhole tool comprising a guide housing having a passage to receive the downhole tool therethrough, flappers, and a driver. The flappers are movably supported about the passage by rods, and movable between a closed position and an open position to selectively define a variable inlet to the passage. The variable inlet is smaller than the passage when the flappers are in the closed position. The driver comprises a translator rotationally coupled to the flappers via the rods and an actuator to rotate the translator, the flappers rotatable between the closed and the open position by the driver whereby passage of the downhole tool into the passage is selectively permitted.

The actuator is an axial or a rotary actuator. The translator comprises a stationary plate and a movable plate, the movable plate axially movable about the stationary plate by the actuator, and cams rotatable by the movable plate. The flappers are connected to the cams by the rods for rotation therewith. The guide assembly may also comprise linear guides linearly supporting the movable plate about the fixed plate. The actuator may comprise a piston and cylinder.

The piston may be positioned adjacent the rod to translate axial movement thereto. The translator may comprise interlocking gears connected to the flappers by the rods to translate rotation therebetween. The actuator may comprise an axial piston rotationally coupled to the interlocking gears by linkages. Each of the interlocking gears may be coupled to one of the flappers via the rods. The actuator may comprise a rotary actuator rotationally coupled to a first end of one of the rods, the actuator rotationally coupled to the interlocking gears via the one of the rods. The interlocking gears may be part of a gearbox. The gearbox may be coupled to a second end of the rods by a bonnet.

The guide assembly is positioned about a blowout preventer and wherein the passage extends through the blowout preventer. The flappers may have an inner surface defining the variable inlet therebetween to receivingly engage tubing. The variable inlet may have a diameter smaller than a diameter of the downhole tool when the flappers are in the closed position.

In another aspect, the disclosure relates to a blowout preventer comprising a blowout preventer housing having a passage to receive a downhole tool therethrough, at least one ram movably positionable about the passage to selectively seal the passage, and a guide assembly positioned about the blowout preventer housing. The guide assembly comprises flappers and a driver. The flappers are movably supported about the passage by rods, and movable between a closed position and an open position to selectively define a variable inlet to the passage. The variable inlet is smaller than the passage when the flappers are in the closed position. The driver comprises a translator rotationally coupled to the flappers via the rods and an actuator to rotate the translator, the flappers rotatable between the closed and the open position by the driver whereby passage of the downhole tool into the passage is selectively permitted.

The guide assembly may be integral with or connected to the blowout preventer housing. The actuator may be coupled to the ram for actuating the ram. The actuator may be operated by a surface unit.

In yet another aspect, the disclosure relates to a method of guiding a downhole tool into a wellbore. The method involves positioning a guide assembly about the wellbore. The guide assembly has a passage in fluid communication with the wellbore comprises flappers. The method also involves selectively permitting passage of the downhole tool through the passage by selectively driving the flappers between a closed position and an open position to define a variable inlet to the passage. The variable inlet has a diameter smaller than a diameter of the downhole tool when in the closed position and a diameter larger than the diameter of the downhole tool when in the open position.

The selectively permitting may comprise closing the flappers about a tubing after the downhole tool is deployed through the inlet via the tubing, rotating the flappers, and/or using axial motion to rotate the flappers.

The method may also involve centering the tubing by guiding the tubing with the flappers, retracting the downhole tool from the passage through the inlet, opening the flappers with the downhole tool by pushing the downhole tool against the flappers during the retracting, preventing the downhole tool from passing into the passage by urging the flappers to the closed position, and/or supporting the downhole tool on the flappers when the flappers are in a closed position.

The disclosure may also relate to a guide assembly for a downhole tool passing into a wellbore by a tubing. The guide assembly including a guide housing, flappers, and a cam driver. The guide housing has a passage to receive the downhole tool therethrough, and the passage being in fluid communication with the wellbore. The flappers are movably positionable about the passage to selectively reduce an inlet thereto. The reduced inlet is smaller than the passage, smaller than the downhole tool, and larger than the tubing. The cam driver includes a movable plate and cams. The movable plate is driven by an actuator, and the cams are operatively connectable to the movable plate and the flappers to translate axial motion of the movable plate to rotationally drive the flappers whereby the passage into the wellbore is controlled. The guide assembly may be integral with wellsite equipment or connectable thereto.

The guide housing may be operatively connectable to wellsite equipment comprising a blowout preventer, and the passage may extend through the blowout preventer to the wellbore. The guide housing may have a port therethrough in fluid communication with the passage. The flappers may include a pair of flappers with a curved inner surface to receivingly engage the tubing. Each of the flappers may include a hinge pivotally movable about the housing.

The guide assembly may also include a rod receivable by each of the hinges and rotationally movable therewith. Each of the rods may have a keyed outer surface matingly receivable by a keyed inner surface of each of the hinges. Each of the cams may include a base operatively connectable to an end of the rod and rotatable therewith and/or a pin receivable in a hole in the movable plate.

The cam driver may also include a fixed plate fixedly mounted to the housing. The movable plate may be movably positionable about the fixed plate, and the cams rotationally connectable to the fixed plate. The actuator may include a piston and cylinder. The piston may be operatively connectable to the movable plate and movable therewith. The actuator may also include a spring positionable about the piston. The flappers may have mated ends with an inner surface defining the inlet therebetween. The reduced inlet has comprises a diameter smaller than a diameter of the downhole tool. The guide assembly may also include supports having edges slidably engageable with the movable plate.

In another aspect, the disclosure relates to a blowout preventer positionable about a wellbore penetrating a subterranean formation. The downhole tool deployable into the wellbore by a tubing. The blowout preventer includes a blowout preventer housing positionable about the wellbore, at least one ram, and a guide assembly. The blowout preventer housing has a passage to receive the downhole tool therethrough, the passage in fluid communication with the wellbore. The ram is movably positionable about the passage to selectively seal the passage. The guide assembly is positioned about the blowout preventer housing. The guide assembly includes flappers and a cam driver. The flappers are movably positionable about the passage to selectively reduce an inlet thereto. The reduced inlet is smaller than the passage, smaller than the downhole tool, and larger than the tubing. The cam driver includes a movable plate and cams. The movable plate is driven by an actuator. The cams are operatively connectable to the movable plate and the flappers to translate axial motion of the movable plate to rotationally drive the flappers whereby the passage into the wellbore is controlled.

The guide assembly may include a guide housing integral with the blowout preventer housing, with the passage extending through the guide housing. The guide assembly may include a guide housing operatively connectable to the blowout preventer housing, with the passage extending through the guide housing. The actuator may activate the rams and/or be operated by a surface unit.

Finally, in another aspect, the disclosure relates to a method of guiding a downhole tool into a wellbore penetrating a subterranean formation. The guide assembly includes positioning a guide assembly about the wellbore with a passage of the guide assembly in fluid communication with the wellbore. The guide assembly includes flappers and a cam driver. The cam driver includes a movable plate operatively connectable to the flappers via cams. The method further involves movably positioning the flappers about the passage to selectively reduce an inlet to the passage. The reduced inlet is smaller than the passage, smaller than the downhole tool, and larger than the tubing. The method further involves controlling passage into the wellbore by axially driving a movable plate to rotationally drive the flappers via the cams.

The movably positioning may involve selectively opening the flappers to receive a downhole tool into the passage, and/or closing the flappers about a tubing after the downhole tool is deployed through the inlet via the tubing. The method may also involve centering the tubing by guiding the tubing with the flappers, retracting the downhole tool from the passage through the inlet, opening the flappers with the downhole tool by pushing the downhole tool against the flappers during the retracting, and/or preventing the downhole tool from passing into the bore by urging the flappers to a closed position.

The controlling may involve advancing a piston to axially drive the movable plate, controlling operation of a blowout preventer, and/or supporting the downhole tool on the flappers when in the flappers are in a closed position.

BRIEF DESCRIPTION DRAWINGS

So that the above recited features and advantages can be understood in detail, a more particular description, briefly summarized above, may be had by reference to the embodiments thereof that are illustrated in the appended drawings. It is to be noted, however, that the appended drawings illustrate only typical embodiments and are, therefore, not to be considered limiting of its scope. The figures are not necessarily to scale and certain features and certain views of the figures may be shown exaggerated in scale or in schematic in the interest of clarity and conciseness.

Figure 2A:
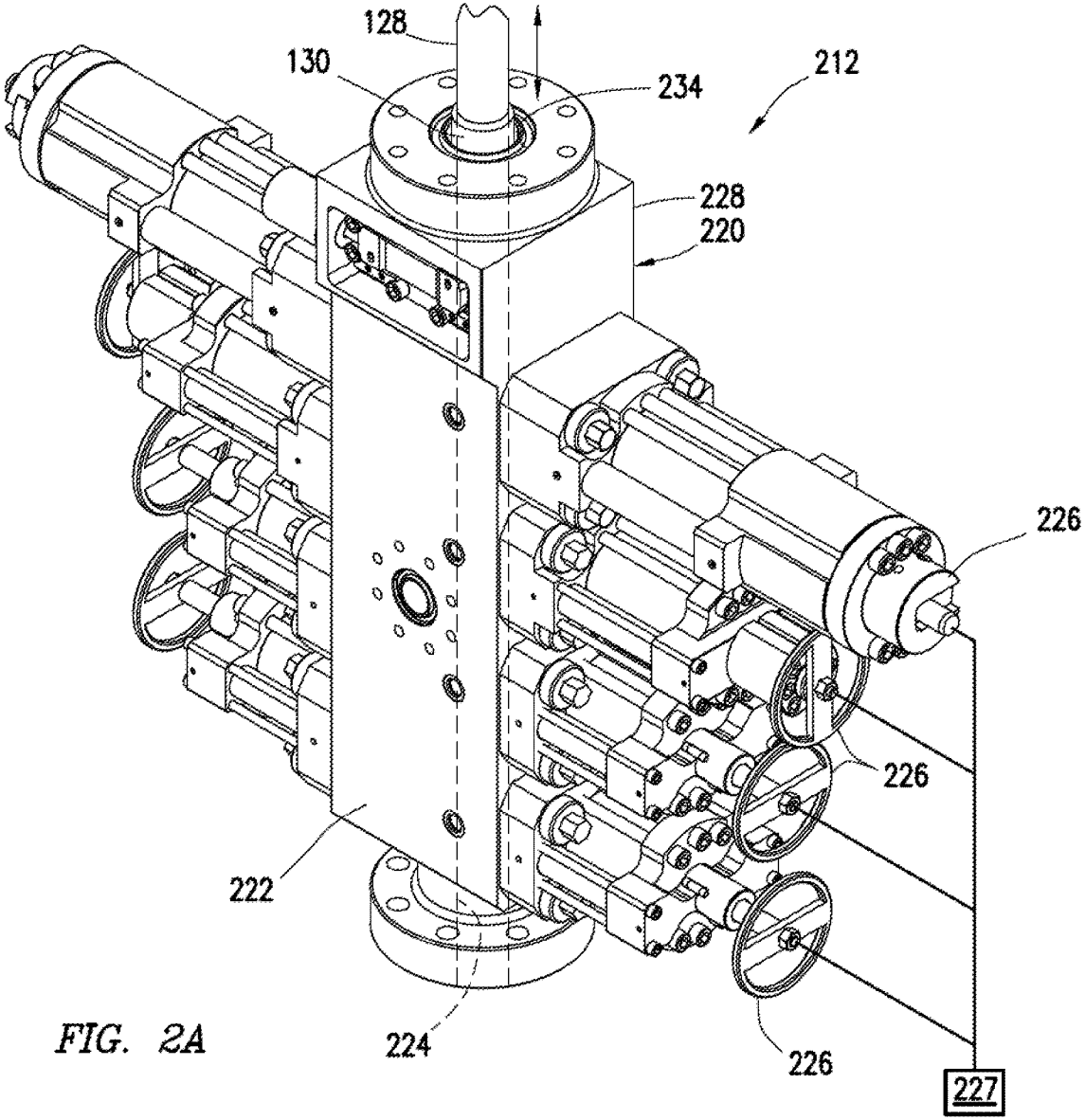
FIGS. 2A and 2B are perspective views of the blowout preventer depicting various views of a cam version of the tool guide assembly.
Figure 2B:
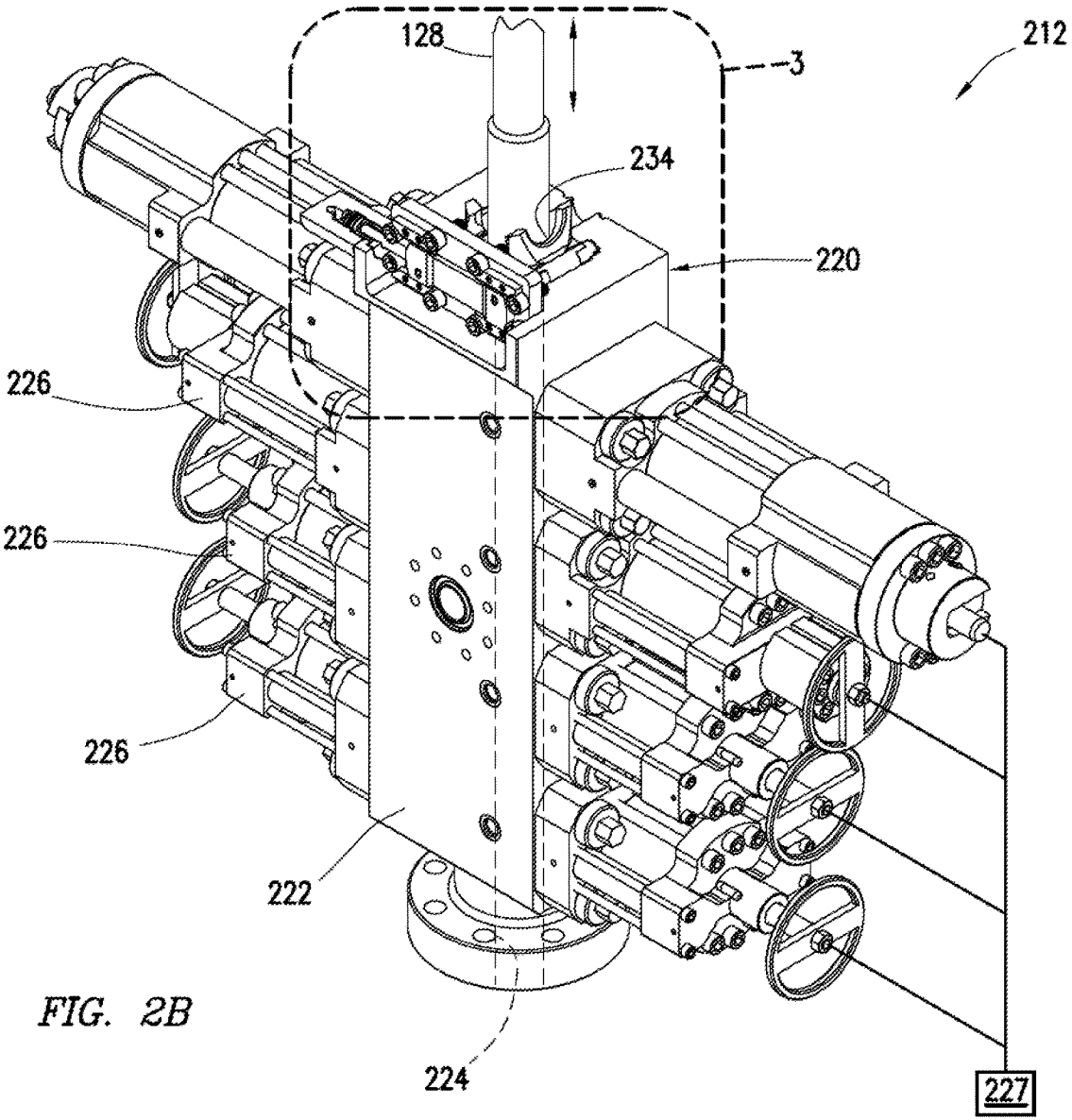

FIGS. 3 A and 3B are detailed views of a portion 3 of the blowout preventer of FIG. 2B with the cam guide assembly in an open and a closed position, respectively, about a downhole tool.

Figure 3A:
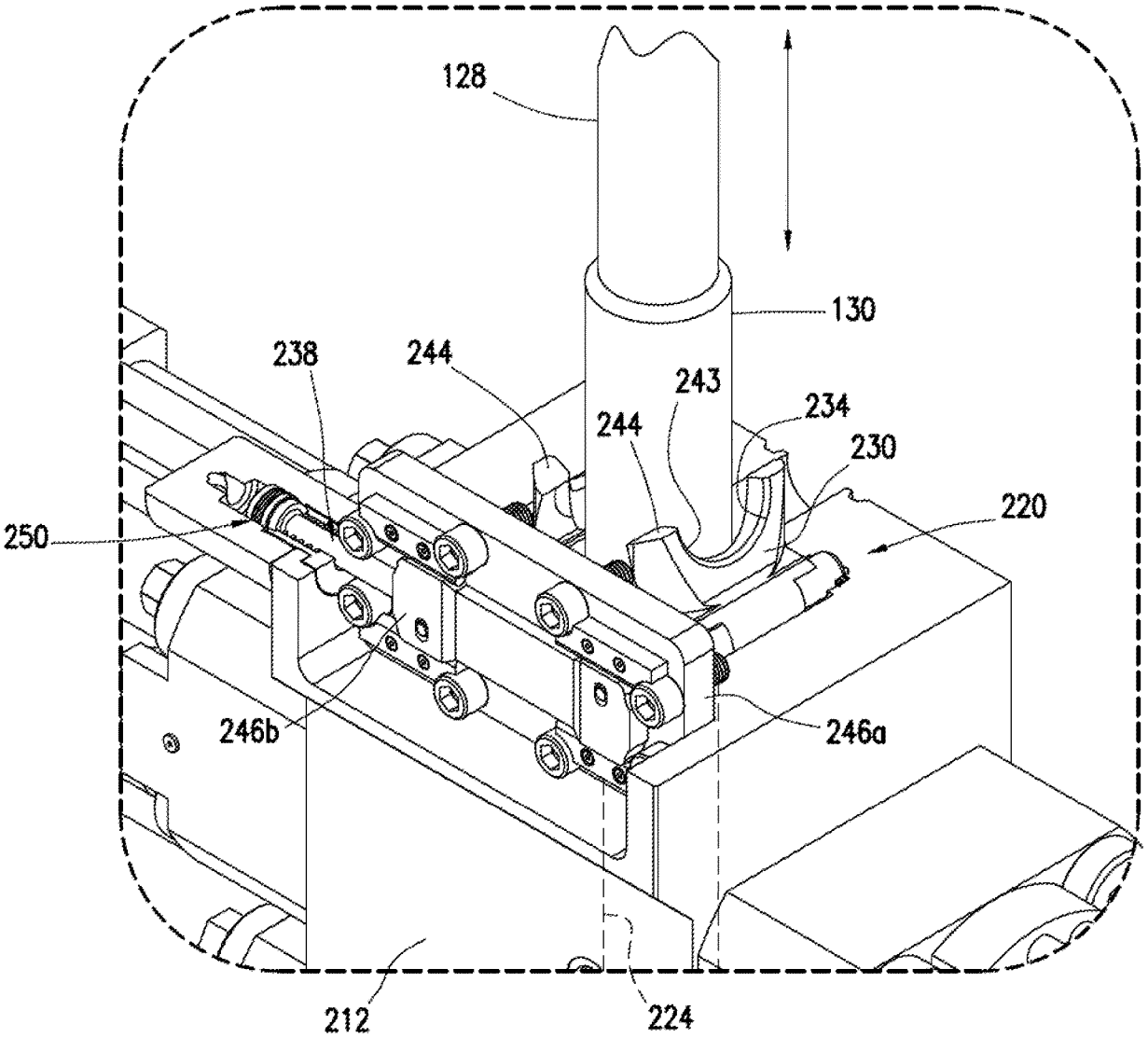
Figure 3B:
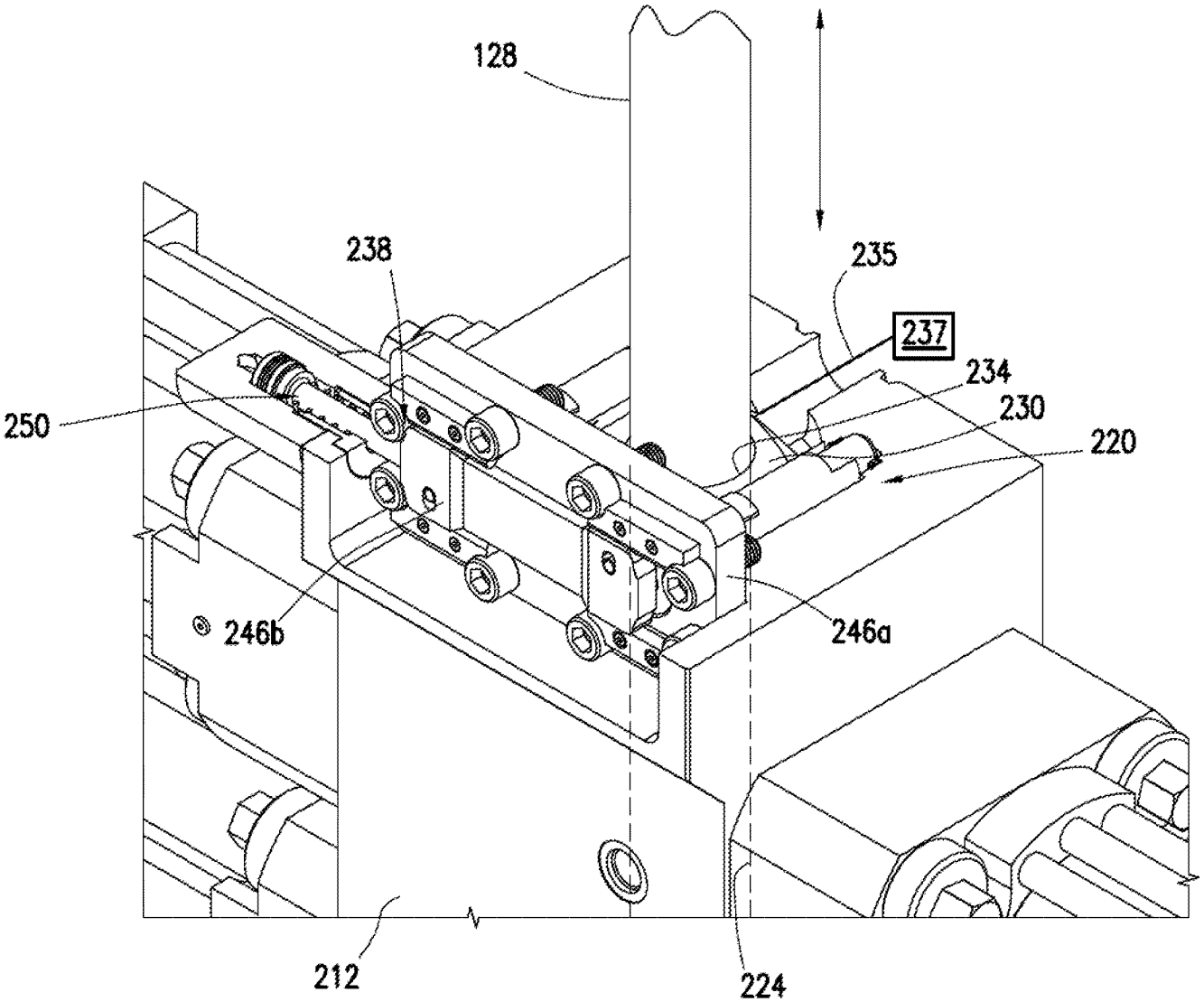
Figure 4A:
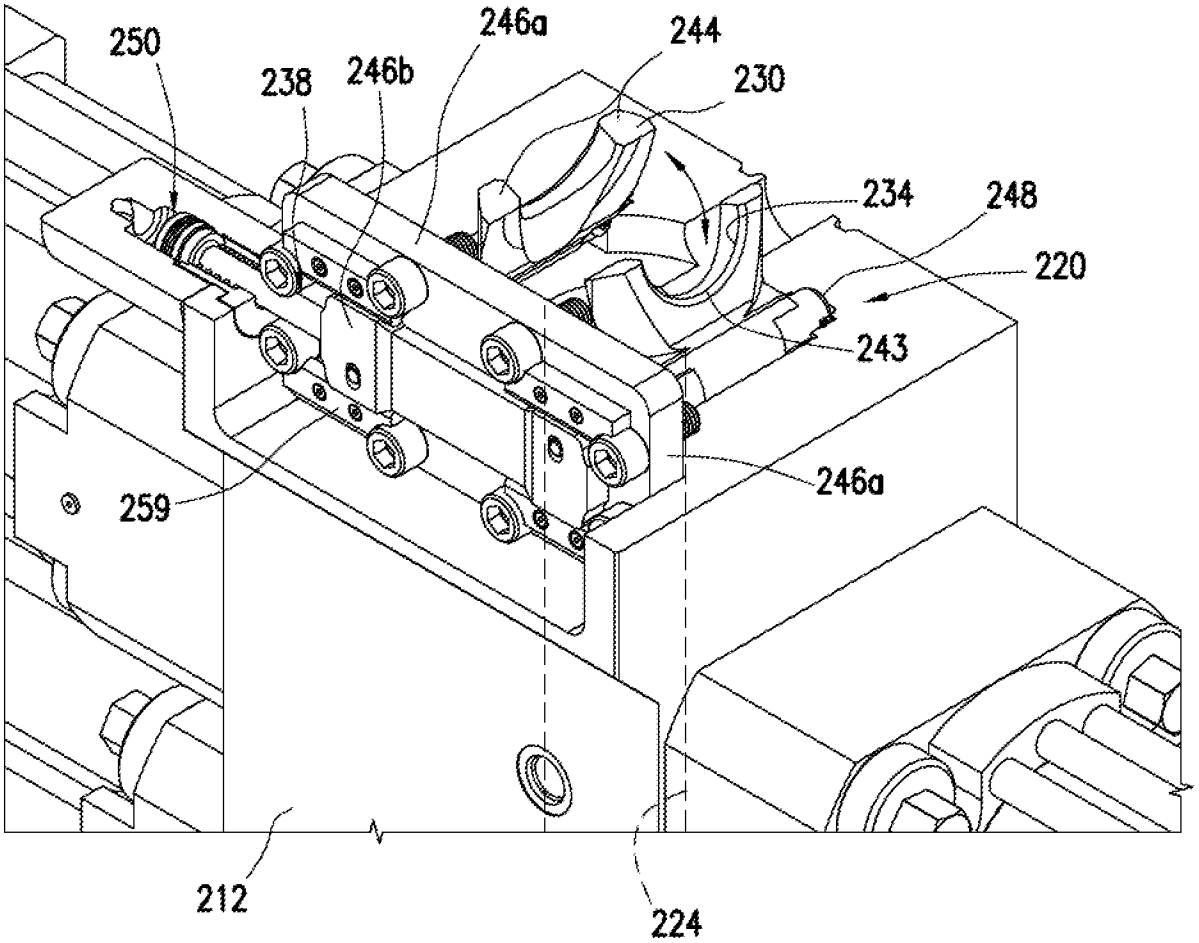
Figure 4B:
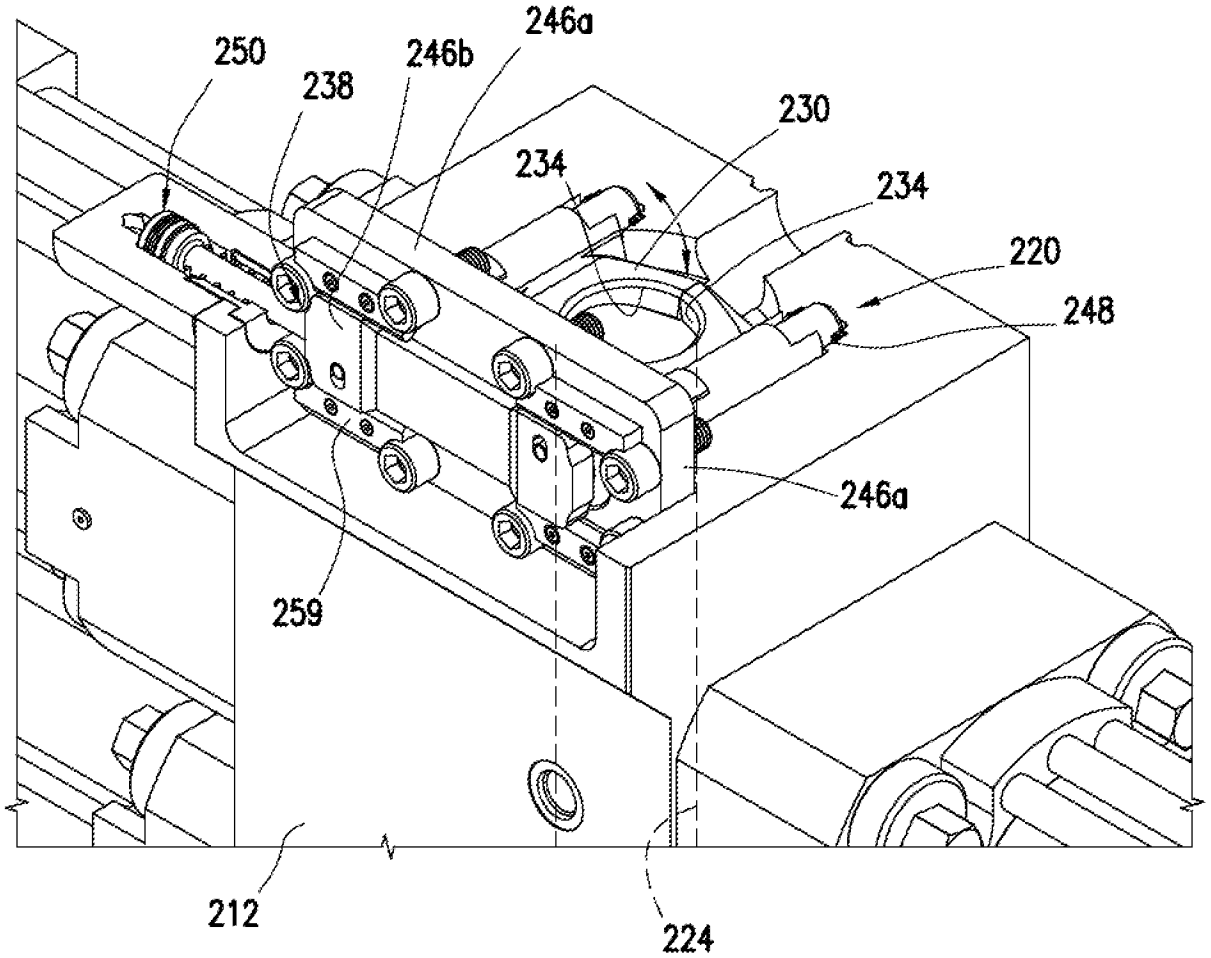

FIGS. 4A and 4B are detailed views of the blowout preventer of FIGS. 3 A and 3B, respectively, with the downhole tool removed.

FIGS. 5 A and 5B are sides views of the blowout preventer of FIGS. 4 A and 4B with, respectively.

Figure 5A:
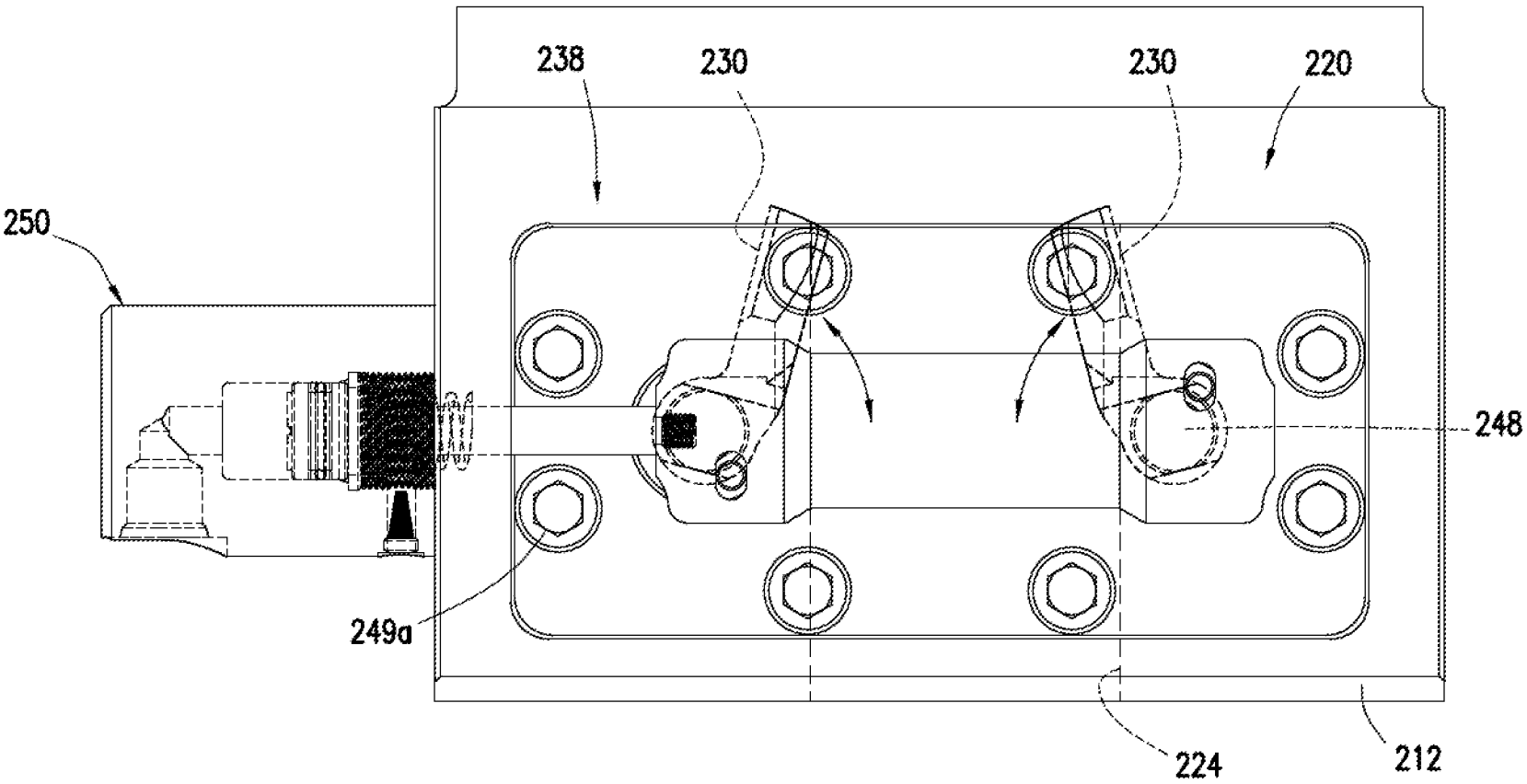
Figure 5B:
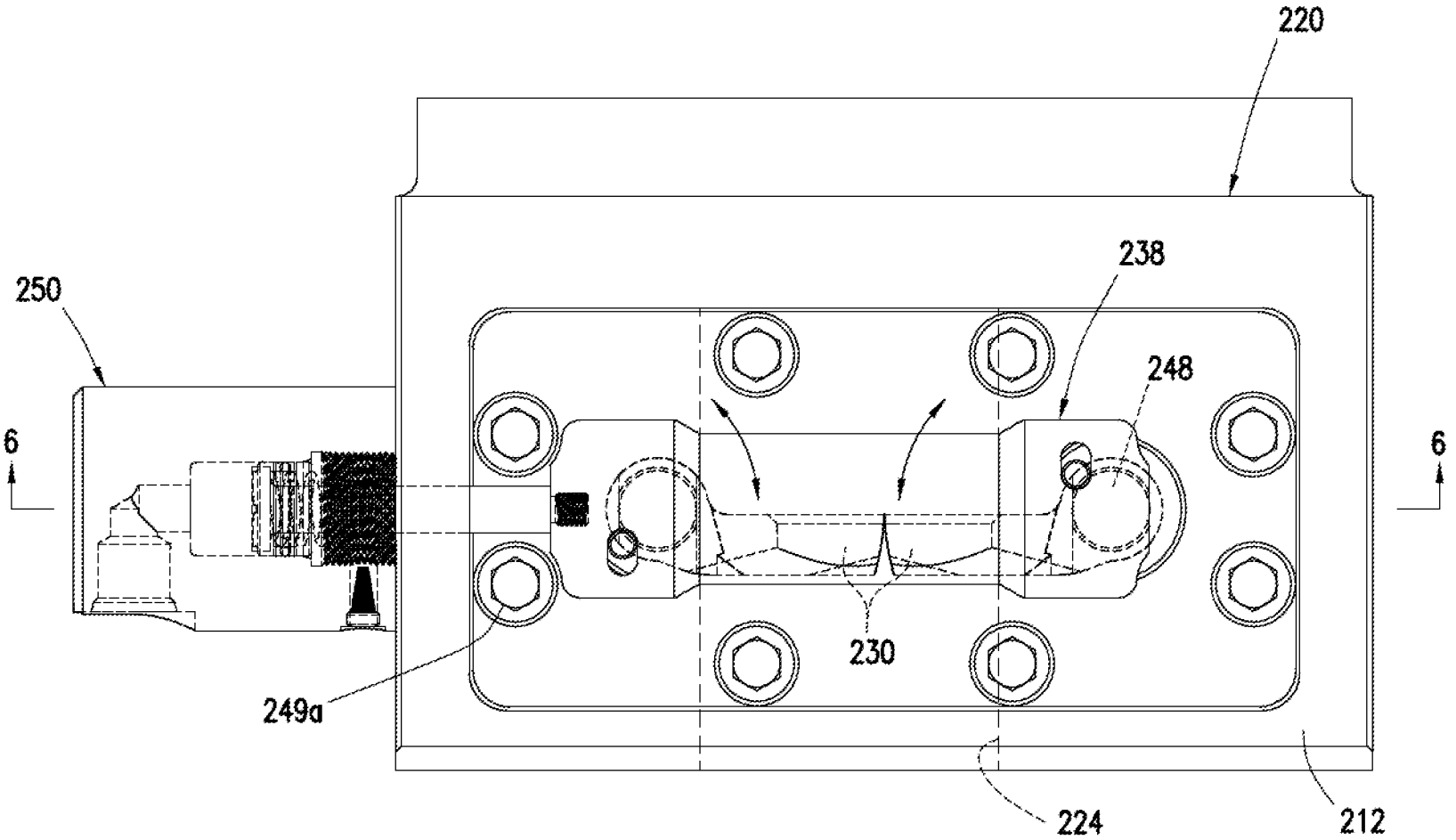
Figure 6:
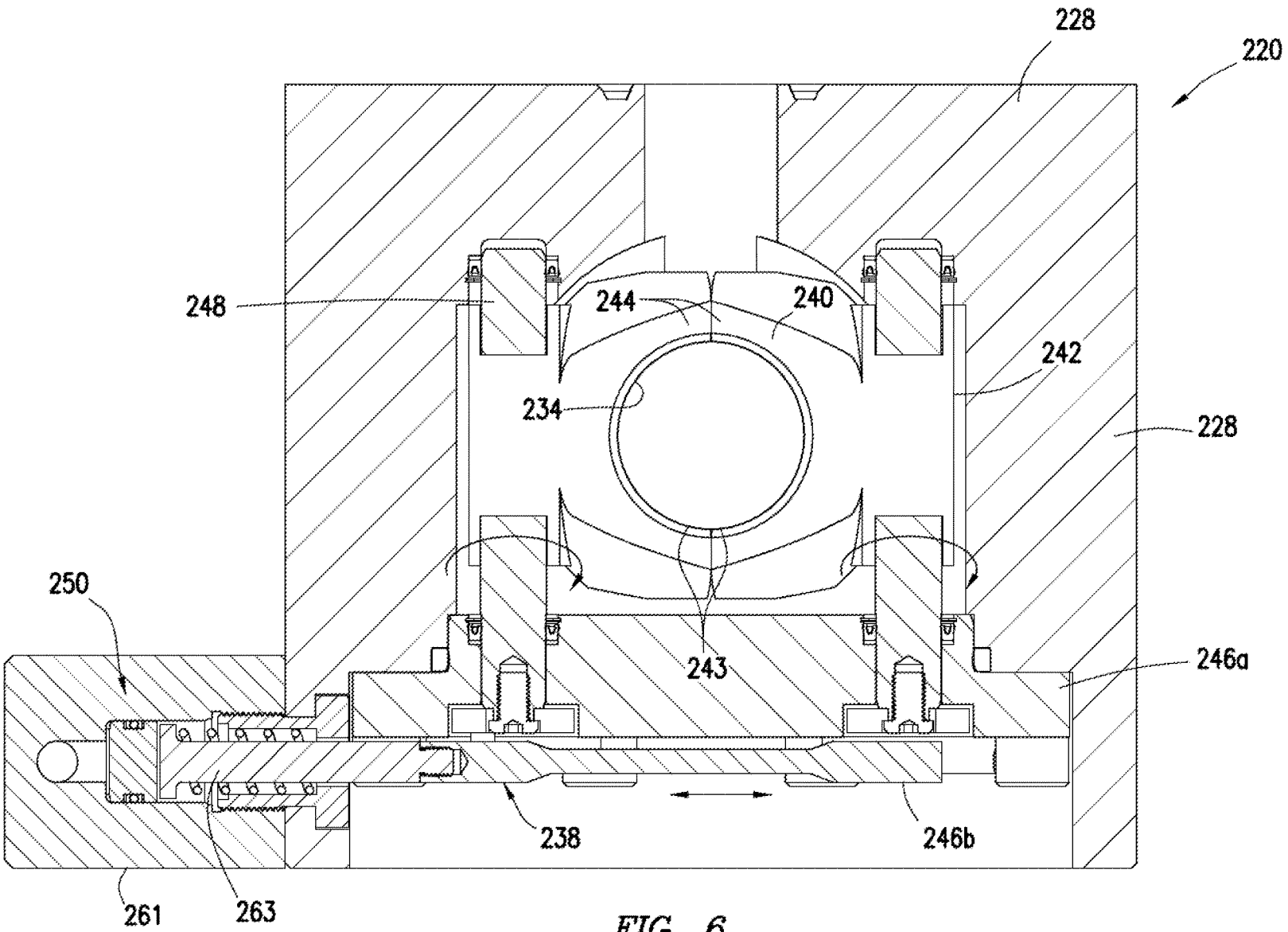

FIG. 6 is a horizontal cross-sectional view of the cam guide assembly of FIG. 5B taken along line 6-6.

Figure 7:
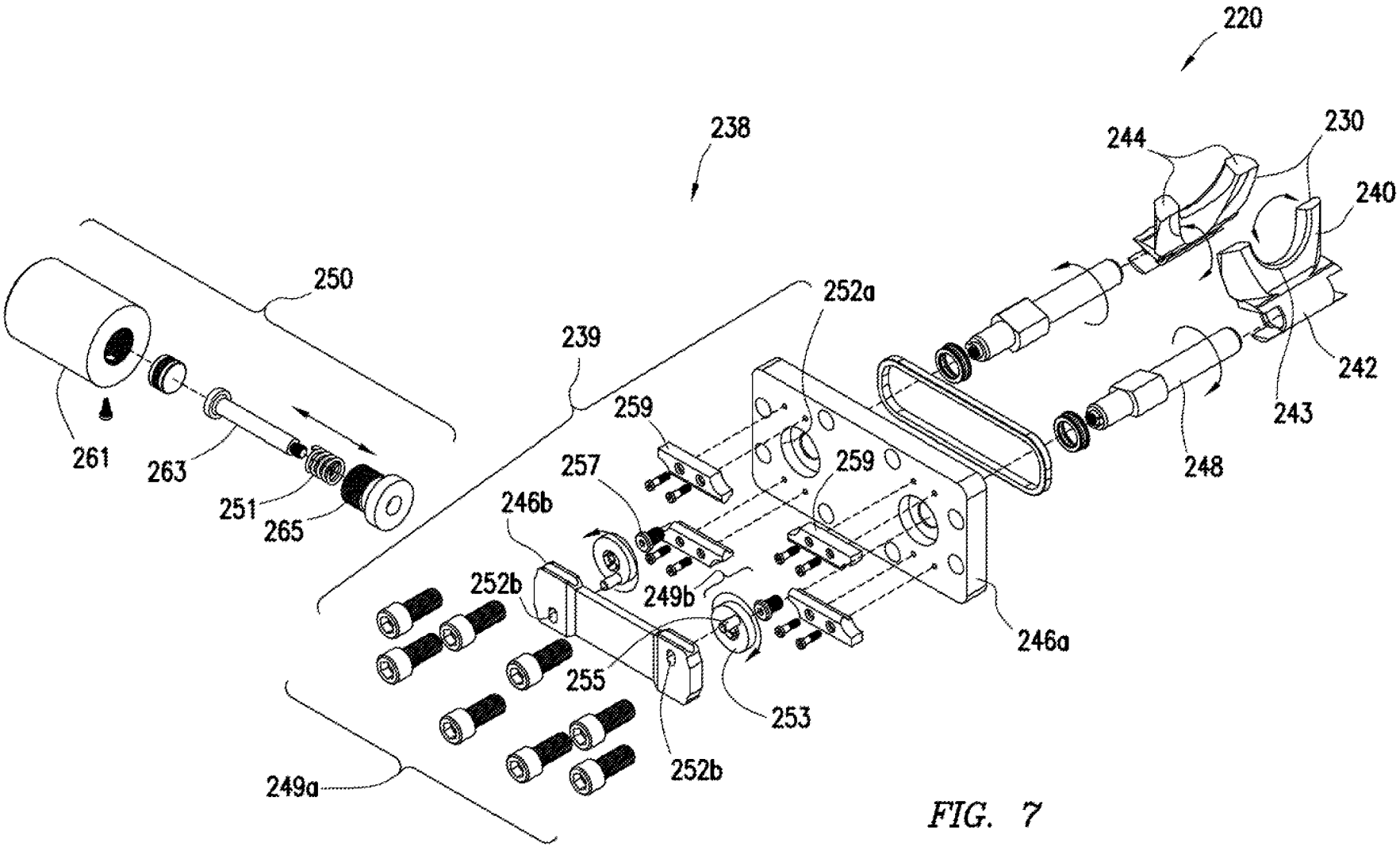

FIG. 7 is an exploded view of the cam guide assembly of FIG. 4 A.

Figure 8:
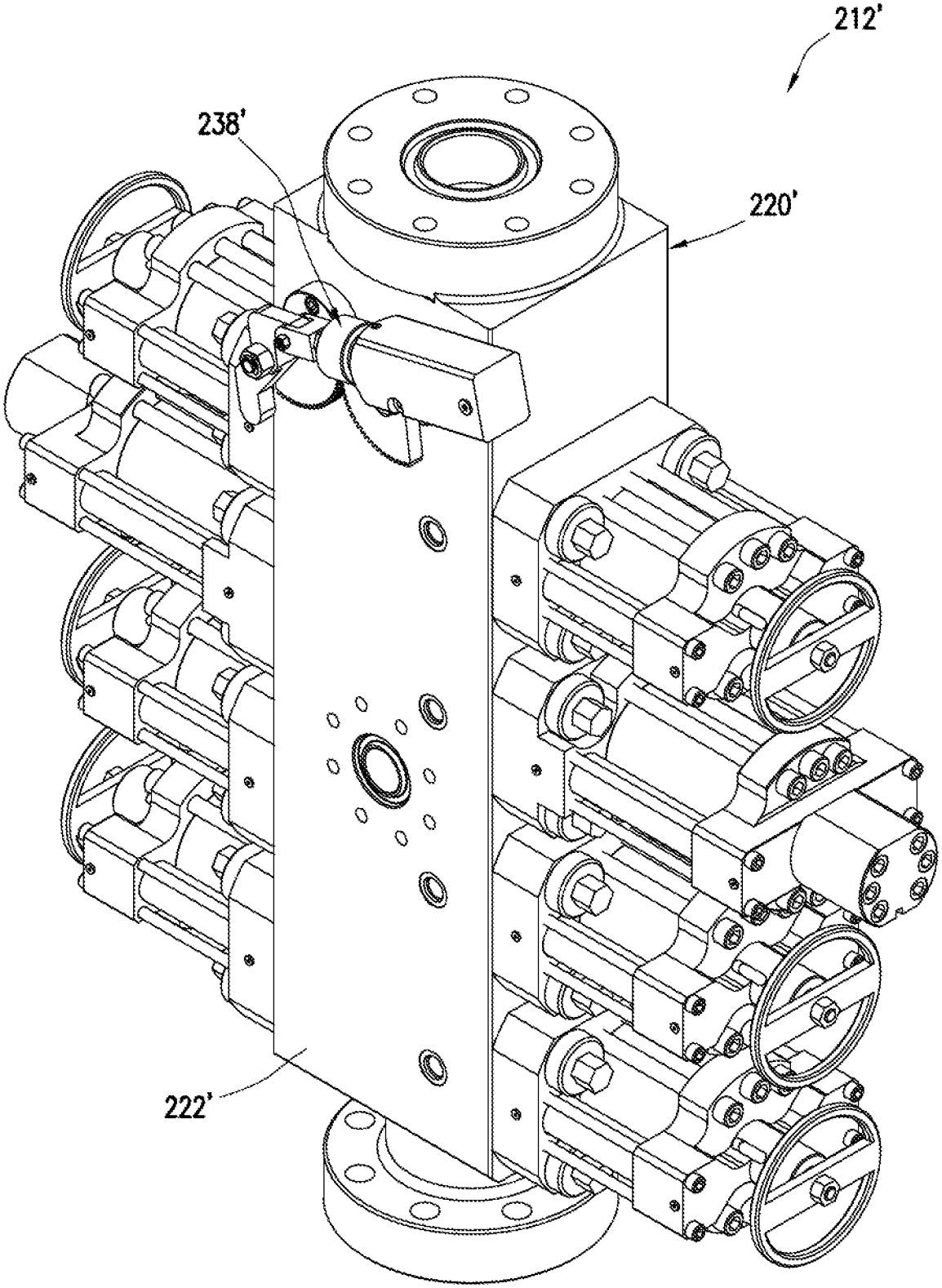

FIG. 8 is a perspective view of a gear version of the tool guide assembly.

FIGS. 9 A and 9B are detailed views of the blowout preventer of FIG. 8 with the gear guide assembly in an open and closed position, respectively.

Figure 10:
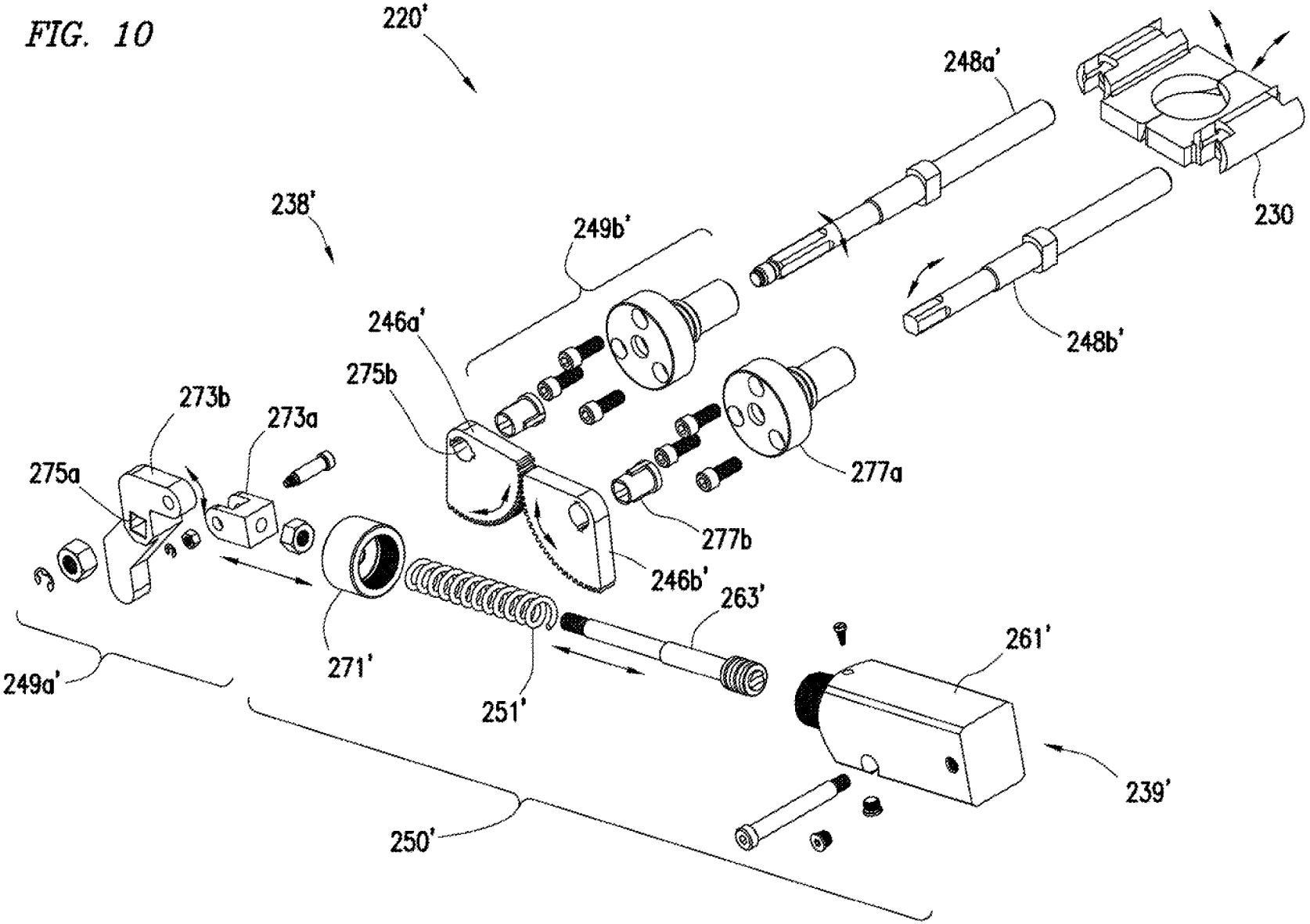

FIG. 10 is an exploded view of the gear guide assembly.

Figure 11:
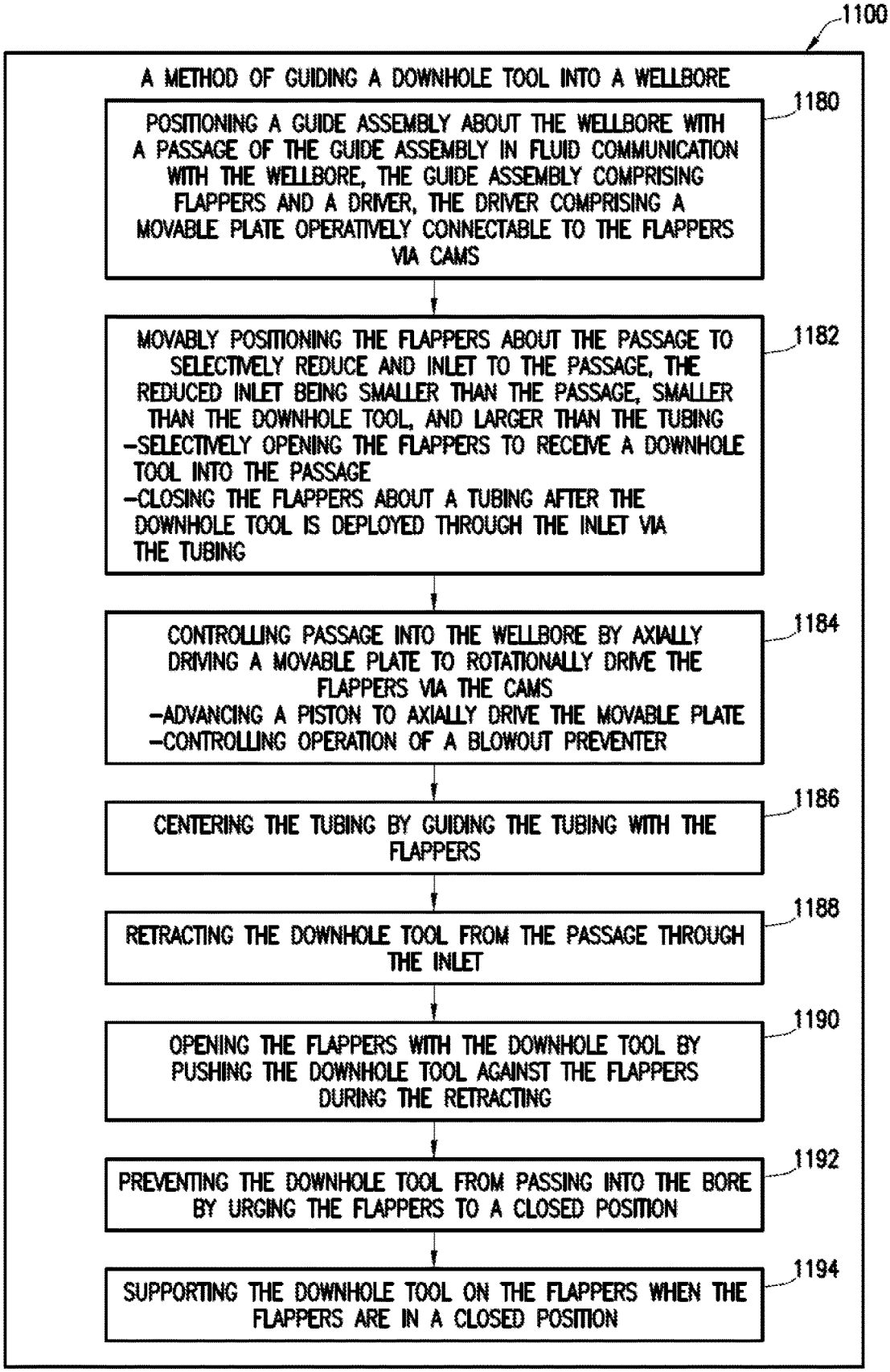

FIG. 11 is a flow chart depicting a method of guiding a downhole tool.

Figure 12:
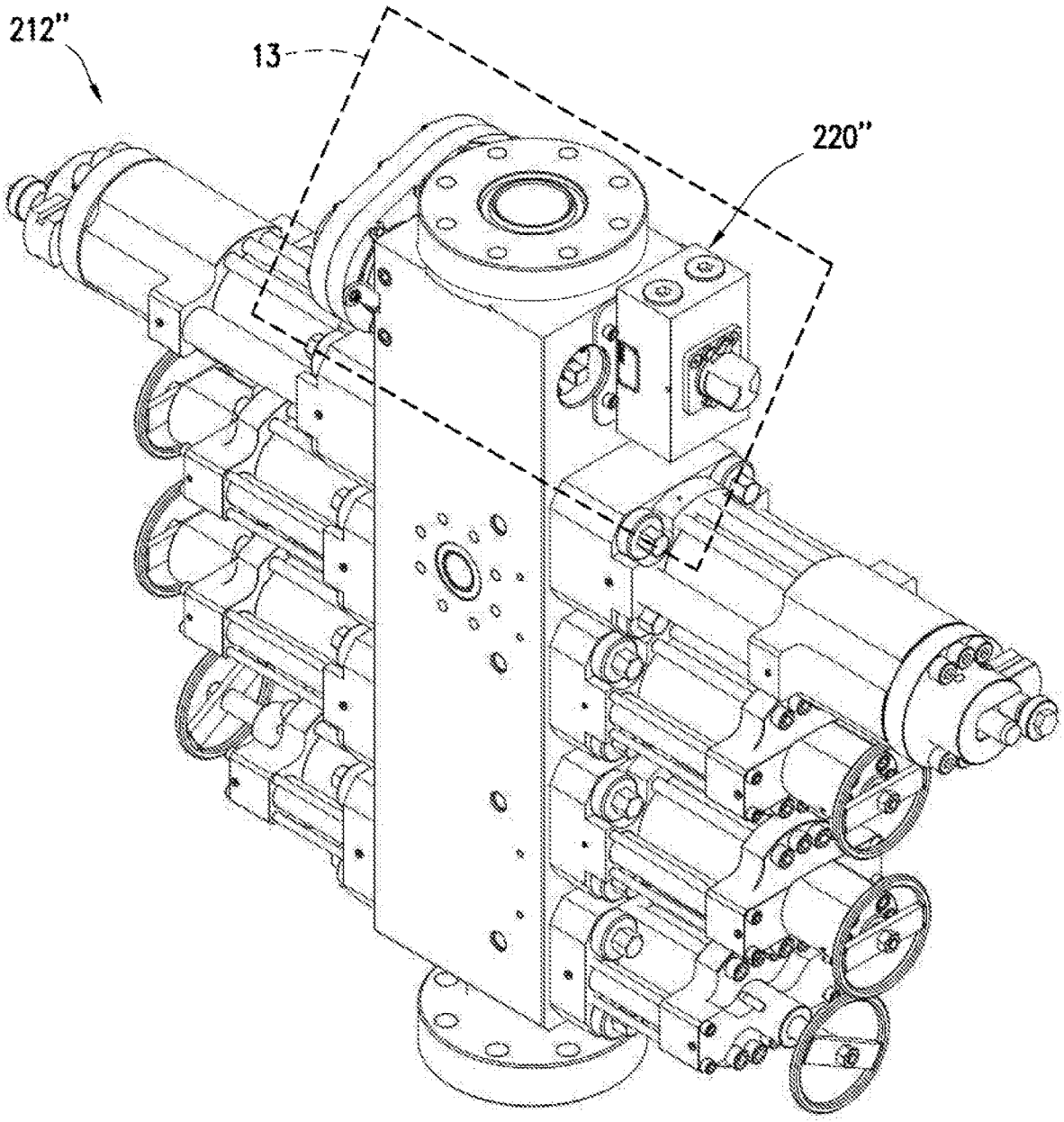

FIG. 12 is a perspective view of the blowout preventer with a rotary version of the tool guide assembly.

Figure 13A:
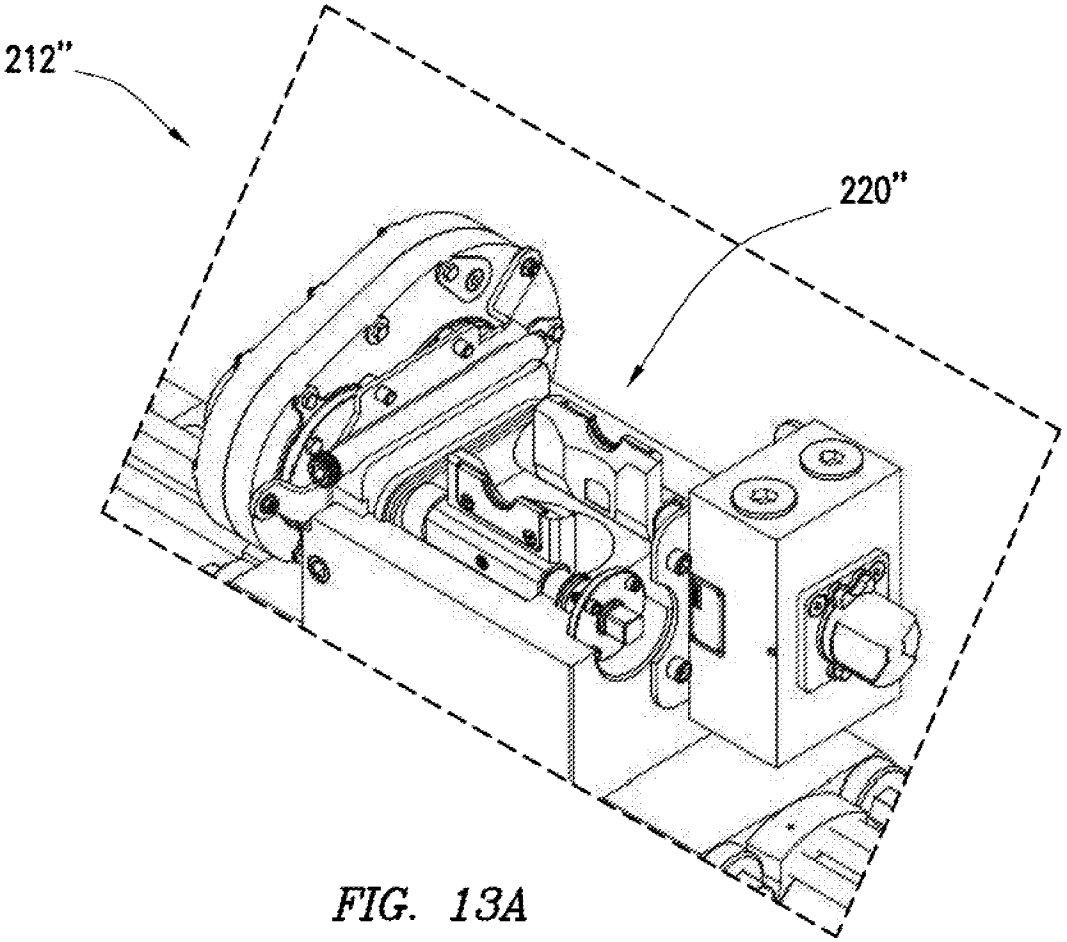
Figure 13B:
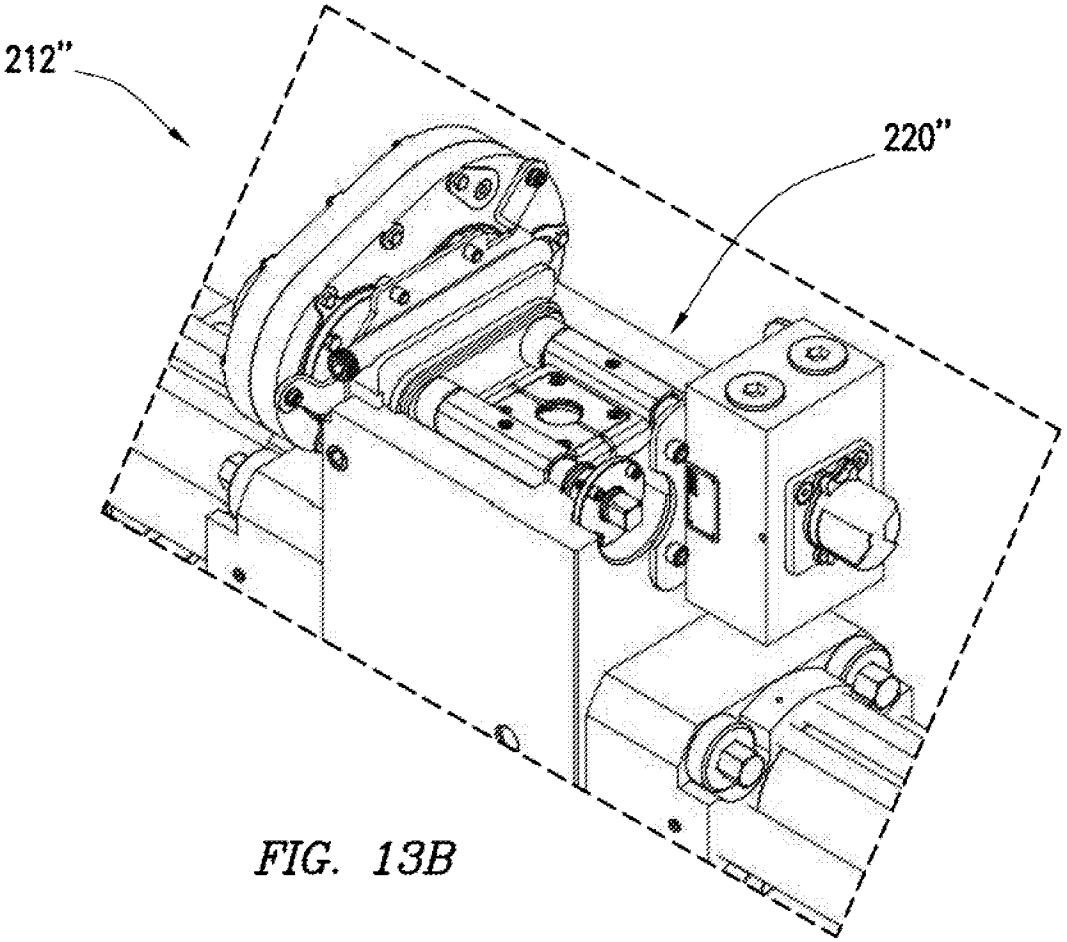

FIGS. 13A and 13B are detailed views of a portion 13 of the blowout preventer of FIG. 12 with an upper end and the downhole tool removed, and with the rotary guide assembly in an open and a closed position, respectively.

Figure 14A:
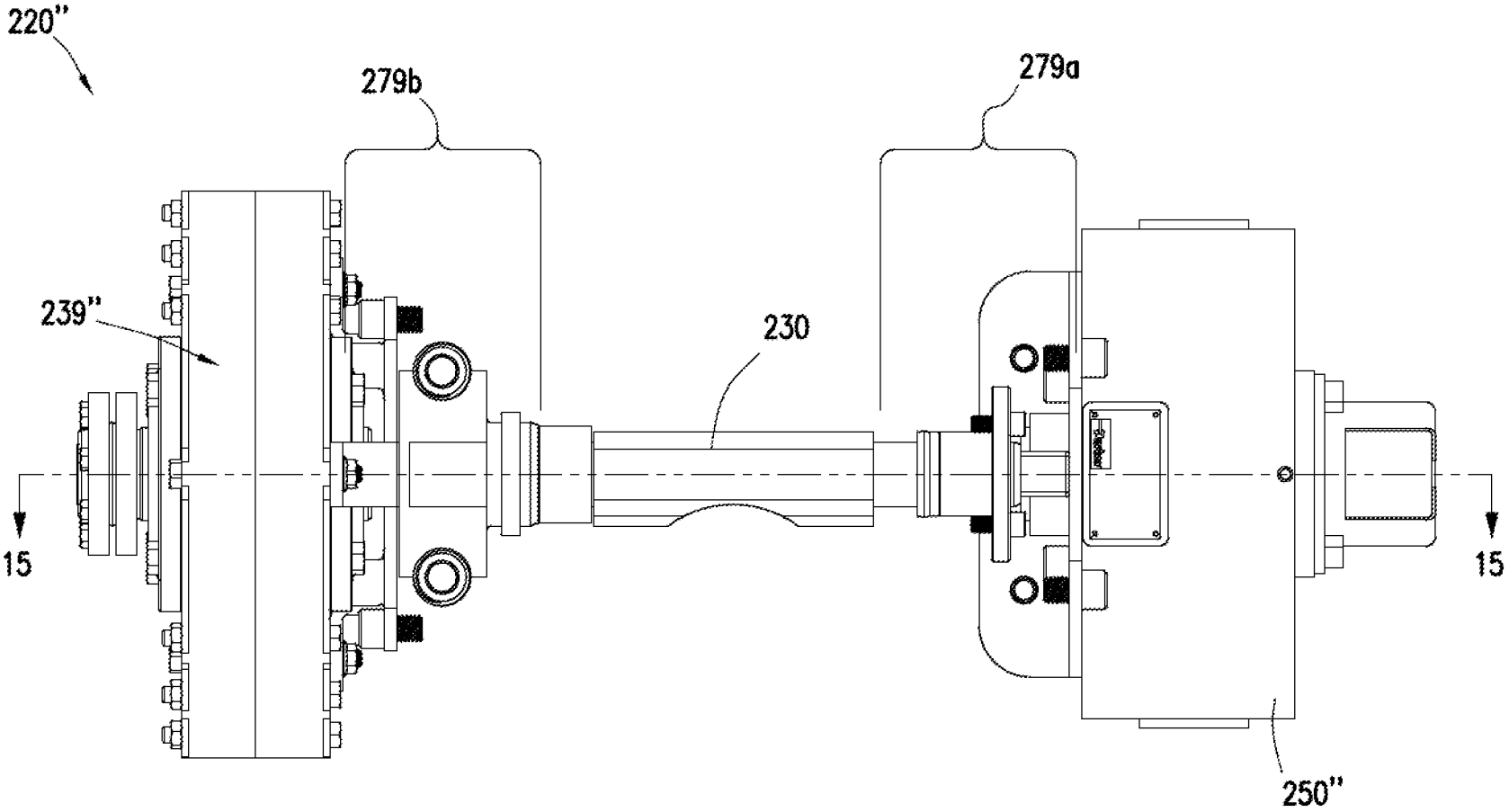
Figure 14B:
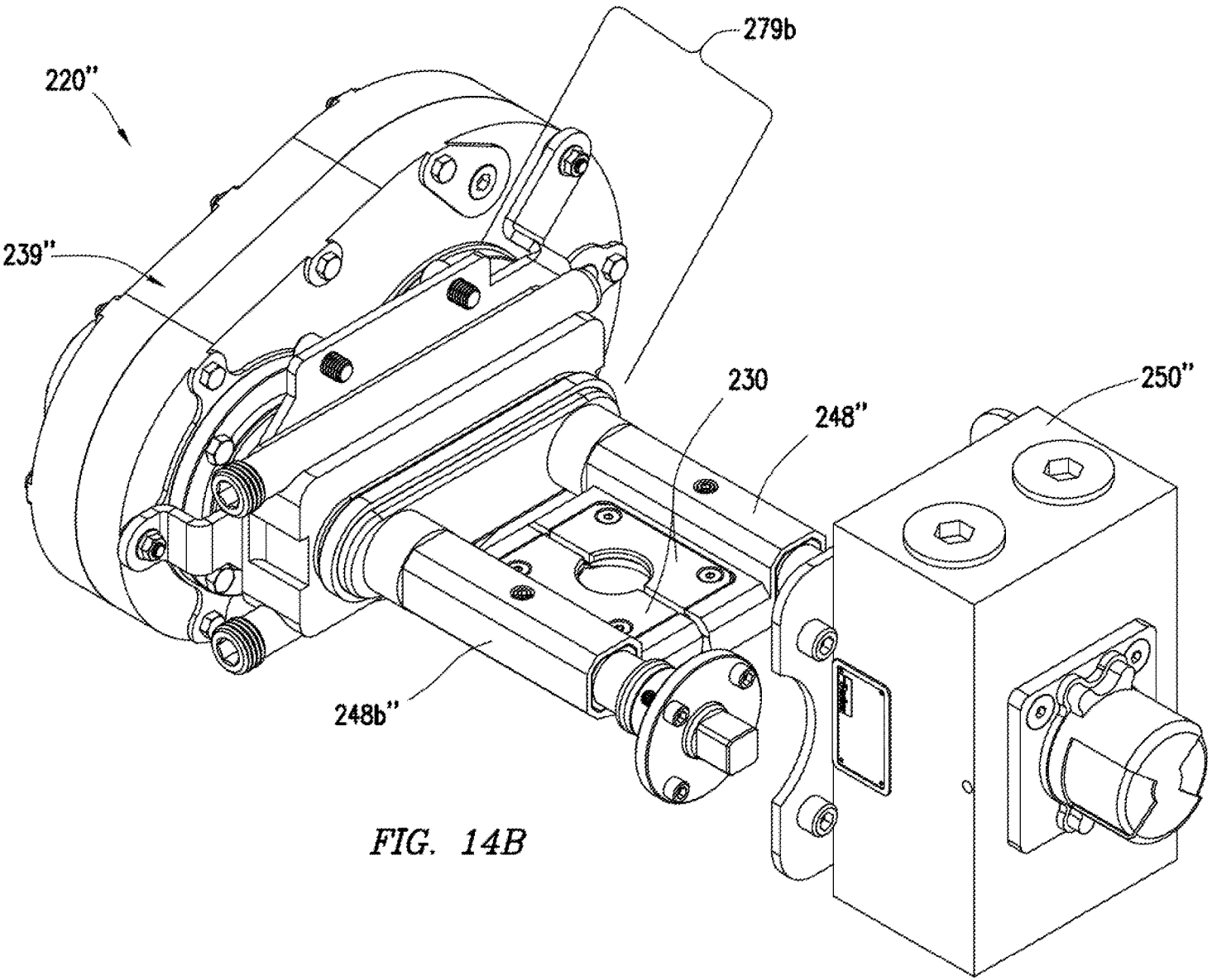

FIGS. 14A and 14B are sides and perspective views of the rotary guide assembly removed from the blowout preventer.

Figure 15:
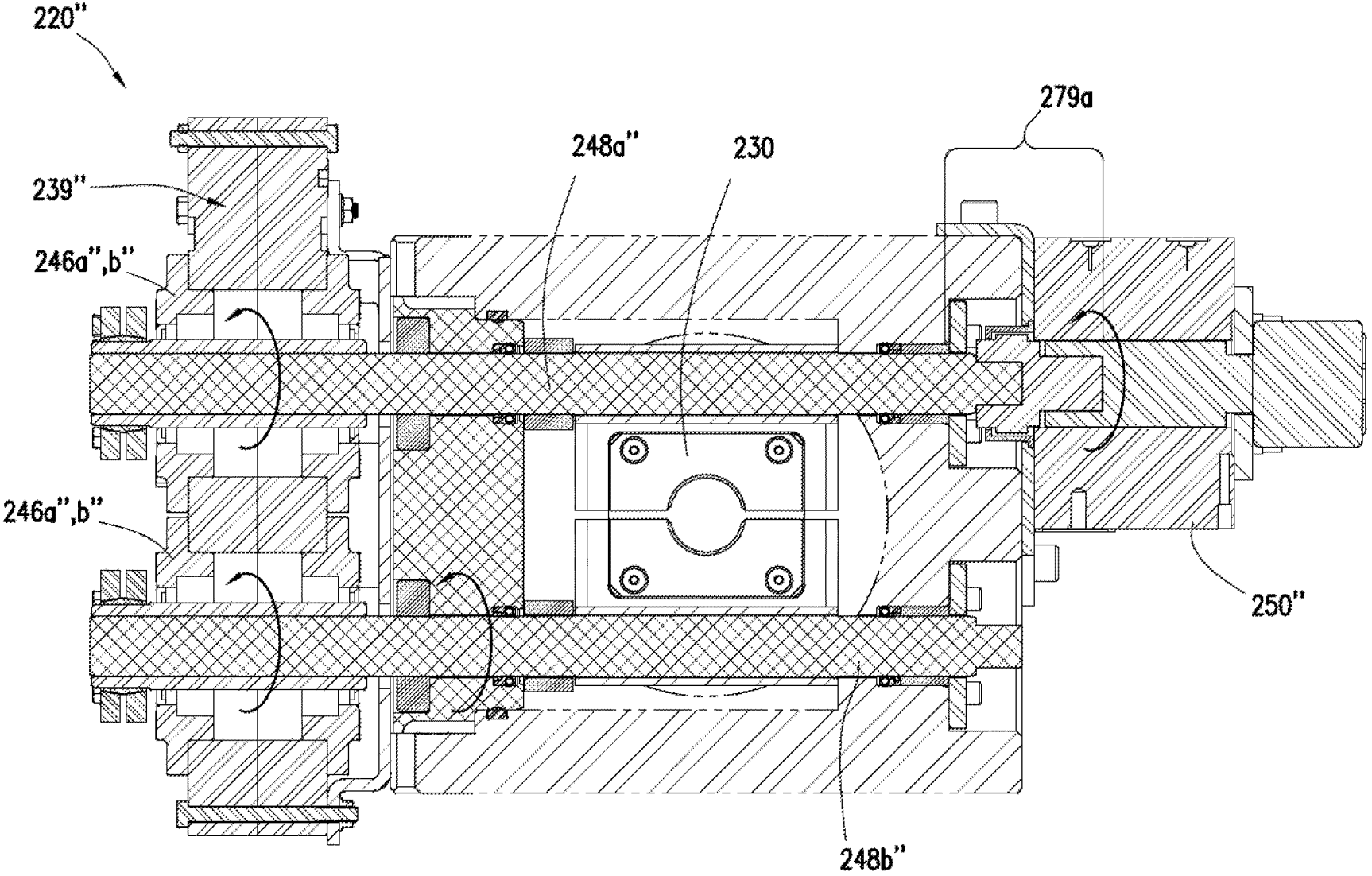

FIG. 15 is a cross-sectional view of the rotary guide assembly of FIG. 14A taken along line 15-15.

Figure 16:
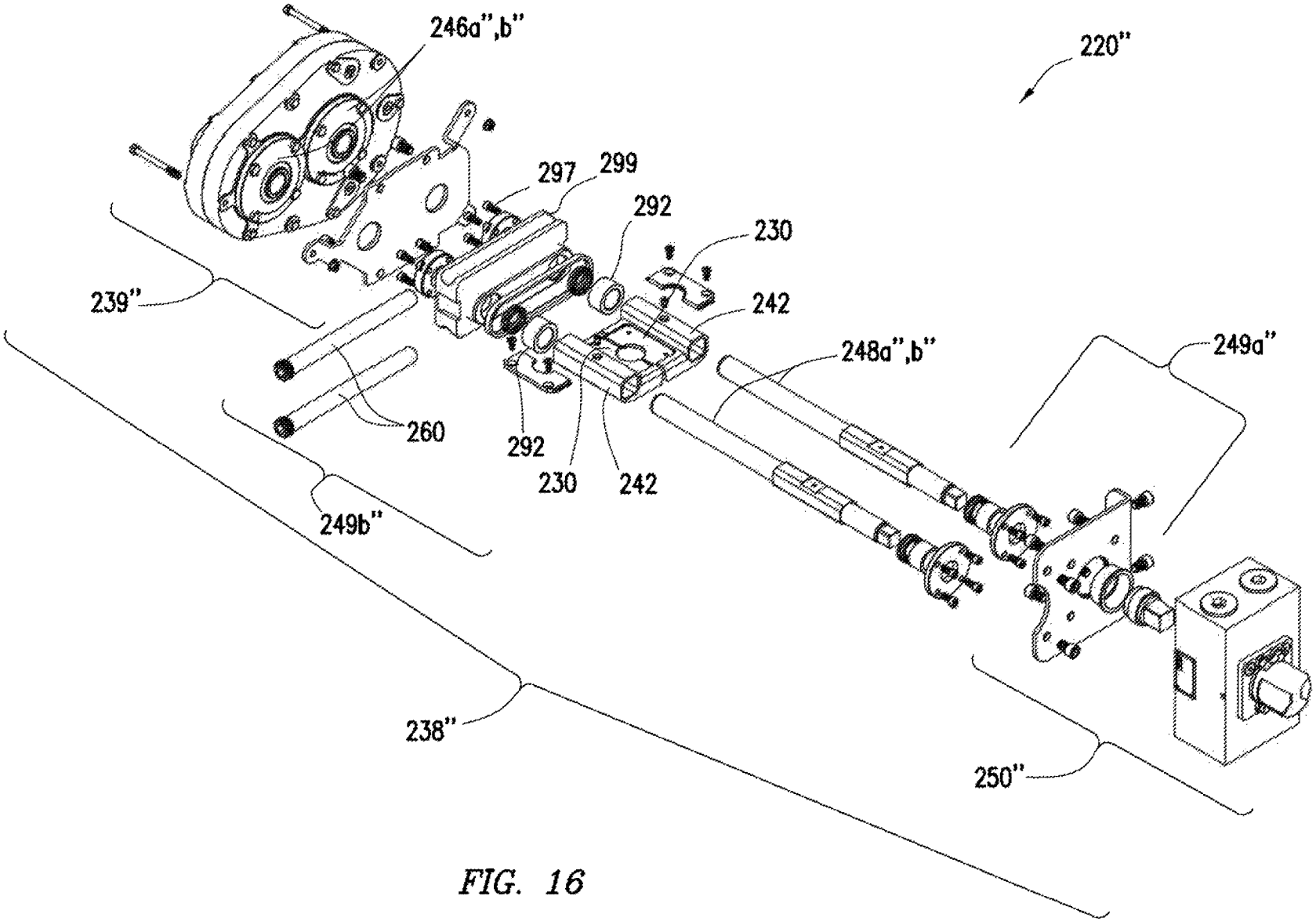

FIG. 16 is an exploded view of the rotary guide assembly of FIG. 14B.

Figure 17:
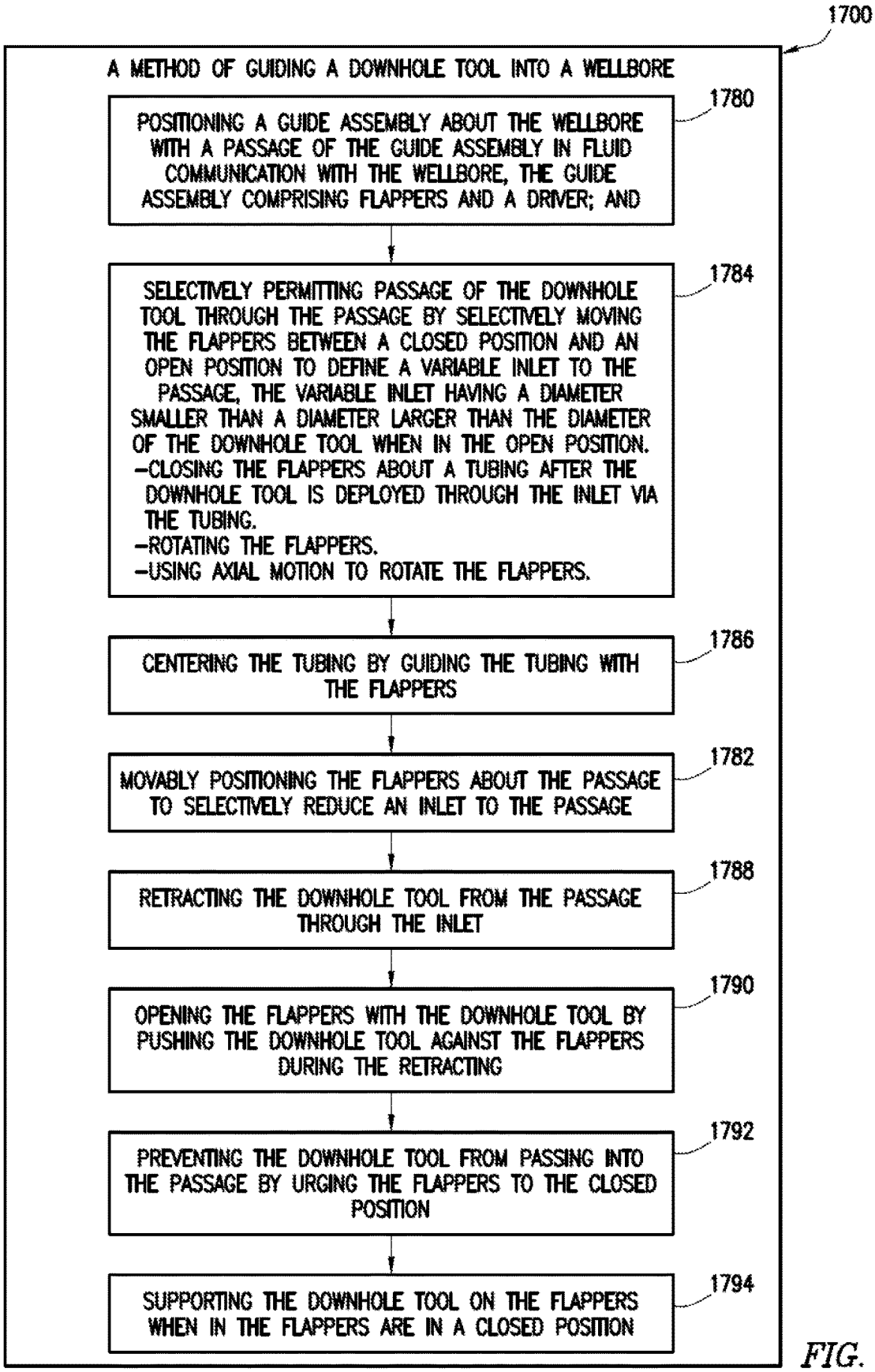

FIG. 17 is a flow chart depicting a method of guiding a downhole tool.

DETAILED DESCRIPTION

The description that follows includes exemplary systems, apparatuses, methods, and instruction sequences that embody techniques of the inventive subject matter. However, it is understood that the described embodiments may be practiced without these specific details.

The disclosure relates to a tool guide assembly for guiding tubulars, such as a downhole tool, as it passes into a wellbore. The tool guide assembly may be positioned about wellsite equipment, such as a blowout preventer (BOP), to restrict and/or control entry therein. The tool guide assembly includes flappers movably positionable about the wellsite equipment to define a variable sized inlet into a passage that leads to the wellbore. The flappers may be operated using a driver, such as a cam, gear, or rotary driver, that is separate from or integral with the wellsite equipment for independent and/or integral operation as desired.

The flappers may be selectively opened to permit entry into the wellbore when desired, and closed about the tubing to guide (e.g., center) the downhole tool and/or tubing as it passes into the BOP and/or the wellbore. Such operation may be used, for example, to prevent unintended entry into the wellbore, and to prevent tangling, buckling, misalignment, stuck-in-hole conditions, and/or misdeployment, among others.

Figure 1:
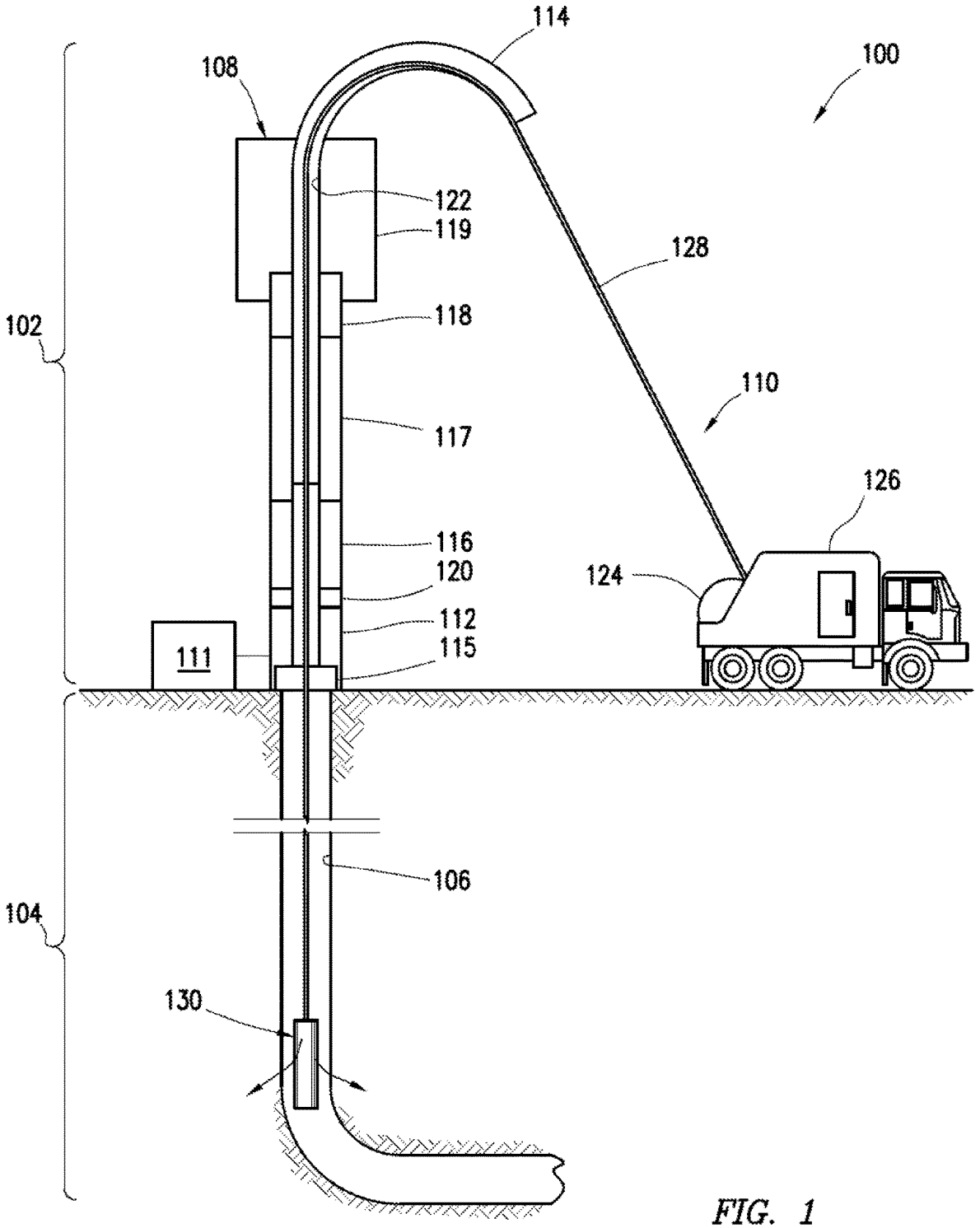
FIG. 1 is a schematic view of a wellsite having downhole tool deployed into a wellbore through a blowout preventer having a tool guide assembly.

FIG. 1 depicts an example environment in which subject matter of the present disclosure may be utilized. This figure depicts a wellsite 100 having surface equipment 102 and subsurface equipment 104 positioned about a wellbore 106. The wellsite 100 is depicted as a land-based wellsite, but could be offshore.

In the example of FIG. 1, the surface equipment 102 includes a surface assembly 108, a tubing assembly 110, and a surface unit 111. The surface assembly 108 includes a blowout preventer (BOP) 112 and a gooseneck 114. The BOP 112 is positioned about a wellhead 115 and may be coupled to or include various components, such as an adapter plug 116, a lubricator 117, a stripper packer 118, an injector 119, and a guide assembly 120. The various components as shown are stacked about the wellhead 115 and have a common passage 122 therethrough in fluid communication with the wellbore 106.

The gooseneck 114 extends from the surface assembly 108 to the tubing assembly 110 to receive the subsurface equipment 104 therethrough. The tubing assembly 110 as shown includes a coiled tubing spool 124 positioned on a carrier 126 to deploy a coiled tubing 128 through the gooseneck 114, through the passage 122 of the surface assembly 108, and into the wellbore 106.

The coiled tubing 128 may have a downhole tool 130 thereon disposable through the passage 122 and into the wellbore 106 for performing downhole operations, such as perforating, injecting, stimulating, measuring, and/or other downhole operations. As shown, the downhole tool 130 is deployed via coiled tubing 128 to inject fluid into the formation surrounding the wellbore 106 to induce production.

The surface unit 111 may be provided with controllers, electronics, central processing units, and/or other devices to monitor, communicate, power, and/or control the surface equipment 102 and/or the subsurface equipment 104. For example, the surface unit 111 may be coupled to the BOP 112 and/or the tool guide assembly 120 to selectively activate such items to open, close, and/or restrict passage 122. The surface unit 111 may also be used to operate the downhole tool 130 and/or other equipment about the wellsite 100.

While the example environment of FIG. 1 shows a specific configuration of a coiled tubing operation, it will be appreciated that the tool guide assembly and/or BOP described herein may be used with a variety of wellsite operations. For example, while the subsurface equipment 104 is depicted as being coiled tubing equipment, other equipment, such as drilling, wireline, production, and/or other tools deployable into the wellbore 106 may be used to perform a variety of downhole operations. In another example, while specific surface components are shown, a variety of components may be assembled about the wellhead 116, such as a low marine riser package (LMRP).

FIGS. 2A and 2B show perspective views of an example BOP 212 with a cam-type guide assembly 220. FIG. 2A shows the cam guide assembly 220 including a guide housing 228 positioned about a top of the BOP 212. FIG. 2B shows the cam guide assembly 220 with the guide housing 228 removed to reveal portions of the cam guide assembly 220.

As shown in FIG. 2 A, the BOP 212 has a BOP housing 222 with a passage 224 therethrough and rams 226. The BOP housing 222 is connectable to the wellhead and other equipment as shown in FIG. 1. In the example shown, the cam guide assembly 220 is connected to the BOP 212, but optionally may be formed integrally therewith. The guide housing 228 has an inlet 234 therethrough which leads to the passage 224 to selectively receive the tubing 128 and/or downhole tool 130. As shown, the tubing 128 and downhole tool 130 are deployed through the cam guide assembly 220 and into the BOP 212 through the passage 224.

The BOP 212 is depicted as having multiple sets of rams 226 to selectively seal the passage 224. The rams 226 may be selectively activated by one or more actuators 227 (e.g., hydraulics) as schematically shown. The rams 226 may be, for example, guillotine, blade, spherical, and/or other rams capable of severing the tubing 128, sealing about the tubing 128, and/or sealing the passage 224. While a specific configuration of a BOP with four sets of rams is shown, various configurations of a BOP and/or rams may be provided. Examples of rams and BOPs are provided in US Patent/Application Nos. 2014/0264099, 2010/0319906, 3235224, 4215749, 4671312, 4997162, 7975761, and 8353338, previously incorporated by reference herein.

In the example shown, the cam guide assembly 220 is shown as being positioned at a top of the BOP housing 222 to selectively restrict access thereto. The cam guide assembly 220 defines a variable inlet 234 to the passage 224 of the BOP 212 as is described further herein.

FIGS. 3 A-5B show various views of the cam guide assembly 220 in an open and closed position. FIGS. 3A-3B show a portion 3 of FIG. 2B with the downhole tool 130 deployed therein via the tubing 128. FIGS. 4A-4B are the same as FIGS. 3 A-3B with the downhole tool 130 removed. FIGS. 5A-5B shows side views of the cam guide assembly 220. As shown in these figures, the cam guide assembly 220 includes flappers 230 moveable between an open and closed position to vary the size of the inlet 234 to the BOP 212.

In the open position of FIG. 3A, the flappers 230 are opened (e.g., lifted) to provide a larger inlet 234 sufficient to permit passage of the downhole tool 130 therethrough. When opened, the flappers 230 diverge to reveal the passage 224 thereby providing an unrestricted and larger opening thereto. The downhole tool 130 is depicted as being larger than the inlet 234 and larger than the tubing 128. The downhole tool 130 is lowered into the inlet 234 via the tubing 128, through the passage 224, and into the wellbore 106.

In the closed position of FIG. 3B, the flappers 230 close about the tubing 128. The inlet 234 is smaller than the passage 224 to restrict entry therein. The inlet 234 also has a diameter smaller than a diameter of the downhole tool 130 to restrict passage through the inlet 234. The inlet 234 may optionally be shaped to conform to an outer surface of the tubing 128. For example, the inlet 234 may be elliptical (e.g., round) and having a dimension (e.g., diameter) sized to receivingly engage and/or receive the tubing 128. The dimension of the flappers 230 may be sized and/or shaped to prevent passage of the downhole tool 130 when closed and allow passage when open. The flappers 230 may also be shaped to support the downhole tool 130 thereon (e.g., as a shelf) when closed.

The flappers 230 may close about the tubing 128 to guide (e.g., centralize) the tubing 128 as it passes through the inlet 234 and into the passage 224. This closed position may also be used to guide (e.g., center) the tubing 128 (and/or the downhole tool 130) as it passes through the BOP 212 and/or the wellbore 106.

The flappers 230 of the cam guide assembly 220 may be urged to the closed position (e.g., by springs). This configuration may allow the inlet 234 to be kept smaller to prevent passage of the downhole tool 130 into the BOP 212 until the flappers 230 are intentionally activated. In the closed position, the flappers 230 may be small enough to prevent passage of the downhole tool 130 and may act as a shelf to support the downhole tool 130 thereon. This configuration may also be used to prevent the downhole tool 130 and/or wellsite equipment from entering into the passage 224 and/or falling downhole until desired.

Once the downhole tool is inside the BOP 212, the flappers 230 may close about the tubing, and then be opened by retracting the downhole tool 130 in the upward direction such that the downhole tool 130 contacts and pushes the flappers 230 to an open position. Once the downhole tool 130 is removed, the flappers 230 may automatically return to the closed position.

FIGS. 3A-7 also show various views of the cam guide assembly 220. As shown in these figures, the cam guide assembly 220 includes the flappers 230 and a cam driver 238. The flappers 230 are positionable about the guide housing 228 to define the variable inlet 234 to the passage 224 based on a position of the flappers 230. As shown for example in FIGS. 6 and 7, each of the flappers 230 includes a receiving portion 240 and a hinge 242 pivotally movable about the housing 228. The hinge 242 of each of the flappers 230 is pivotally supported about the guide housing 228 to permit the flappers 230 to open and close.

The receiving portion 240 of each flapper 230 has a curved inner surface 243 shaped to receive a portion of the tubing 128. In the example shown, the inlet 234 of the flappers 230 combine to define a circular inlet that conforms to the outer surface of the tubing 128, and mated ends 244 of the receiving portion converge to encircle the tubing 128. The mated ends 244 are matable with ends of an adjacent flapper for engagement therebetween. The curved inlet is between the matable ends 244 to receive the tubing 128 therein. The example also shows the flappers 230 as including a pair of identical flappers, but any number and shape may be provided. The flappers may be, for example, in the shape of a scotch yoke mechanism.

The flappers 230 are movable by a driver, such as the cam driver 238. The driver may include a first driver or actuator 250 and a second driver or translator 239 to rotate the flappers 230. The actuator 250 generates motion to drive (or actuates or move) the translator 239. In this example, the translator 239 includes plates 246*a,b*, rods 248, and connectors 249*a,b* to rotate the flappers 230, and the actuator 250 to axially drive the translator.

The plates 246*a,b* include a fixed plate 246*a* with a movable plate 246*b* slidably positionable therealong. The fixed plate 246*a* may be secured to the guide housing 228 or may be integral therewith. In this example, the connectors 249*a* are bolts used to secure the fixed plate 246*a* to the guide housing 228, but any means (e.g., weld, integral structure with the housing, etc.) may be used to secure the fixed plate 246*a* in place. Holes 252*a,b* extend through the plates 246*a,b* to receive the connectors 249*a*.

The rods 248 have a first end rotationally coupled to the guide housing 228. The flappers 230 are rotationally supported by the rods 248. The hinges 242 have openings to receive the rods 248 therein. The rods 248 may have a keyed or slanted outer surfaces receivable by a corresponding keyed or slanted inner surfaces in the hinges 242 such that rotation of the rods 248 rotates the hinges 242 and thereby the flappers 230 connected thereto. The rods 248 have a second end extending through the holes 252*a* of the fixed plate 246*a*, and are connectable to the movable plate 246*b* by the connectors 249*b*.

The connectors 249*b* are positioned between the plates 246*a,b* and are connected to the second end of the rods 248 and rotate therewith. Each of the connectors 249*b* as shown include a rotating cam 253 with a pin 255 extending therefrom, and a screw 257 to secure the cam 253 to the rod 248. The pins 255 extend through the holes 252*b* in to the movable plate 246*b* to permit cam movement therebetween.

Supports 259 are secured to the fixed plate 246*a* adjacent movable plate 246*b* to provide support thereto. The supports 259 may be positioned adjacent upper and lower edges of the movable plate 246*b* to define a position of the movable plate 246*b*. These supports 259 may act as a guide to retain the movable plate 246*b* along a linear path as the movable plate 246*b* translates along the fixed plate 246*a*. Optionally, the supports 259 and the movable plate 246*b* may have corresponding edges (e.g., tongue and groove, rails, etc.) that matingly engage to allow the movable plate 246*b* to ride along the supports 259.

The actuator 250 is connected to the movable plate 246*b* for actuation thereof. The actuator 250 may be any mechanism, such as a cylinder 261 with a piston 263, coupled to the movable plate 246*b* to generate the movement needed to open and close the flappers 230. The actuator 250 also includes a plunger 265 connected to the movable plate 246*b* to extend and retract the movable plate 245*b* between the open and closed positions. Spring 251 is provided about the piston 263 to urge the flappers 230 towards the closed position.

The actuator 250 selectively extends and retracts the piston 263 to axially move the movable plate 246*b* back and forth. This movement shifts the pins 255 to rotate the cams 253, thereby rotating the rods 248 and the flappers 230. Thus, axial motion from the movable plate 246*b* is translated by translator 239 into rotation of the rods 248 and opening and closing of the flappers 230. The actuator 250 may be hydraulically and/or electrically driven to axially advance and retract the movable plate 246*b*. The actuator 250 may optionally be the same actuator 227 used to operate the rams (FIGS. 2A and 2B). The surface unit 111 may optionally be used to activate the actuators 227 and/or 250.

The cam guide assembly 220 may be provided with various optional features, such as seals, flowlines, and other items. For example, as shown in FIG. 3B, a fluid port 235 (and/or a flowline) may be provided for allowing fluid to pass between the passage 224 and an external reservoir 237.

Figure 9A:
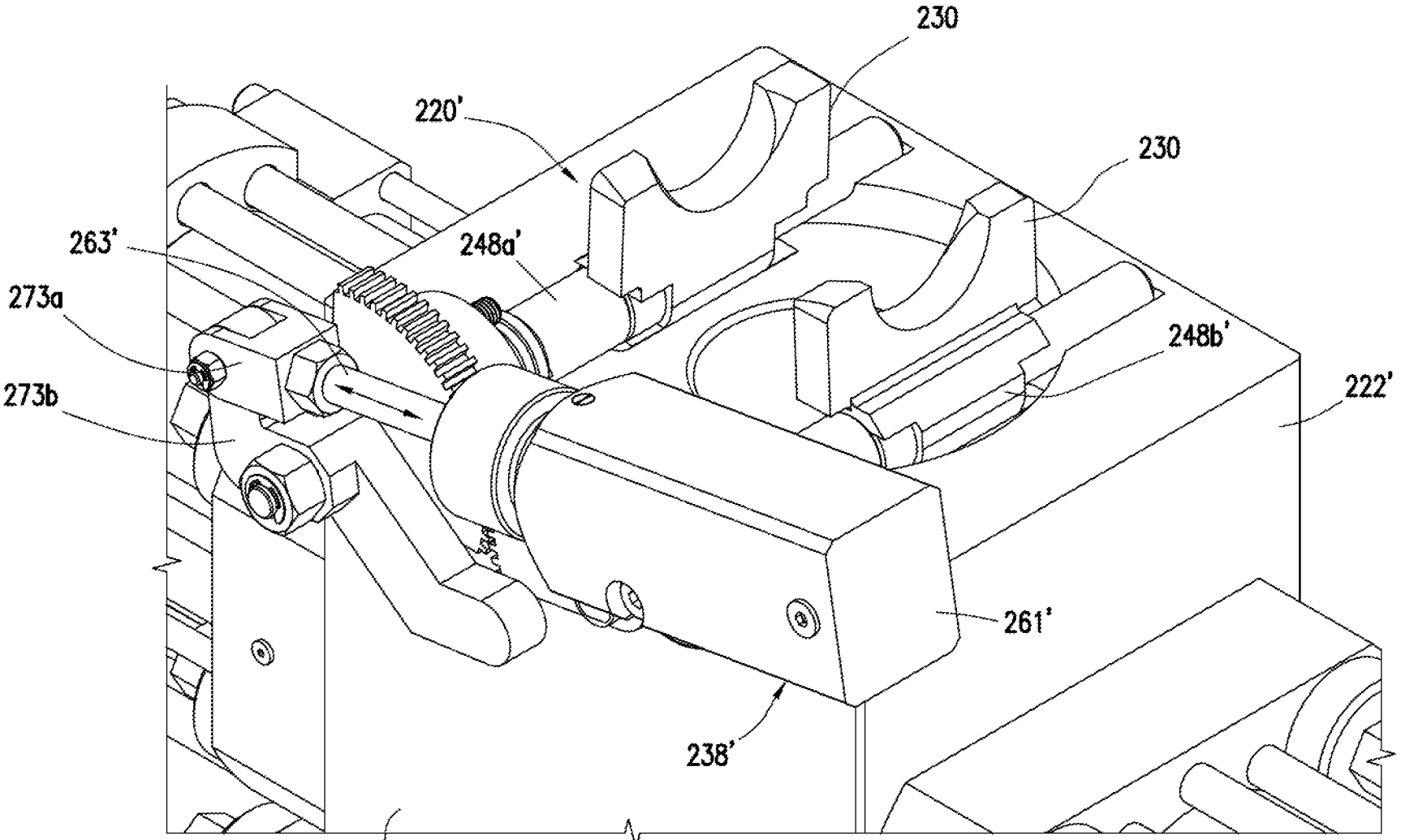
Figure 9B:
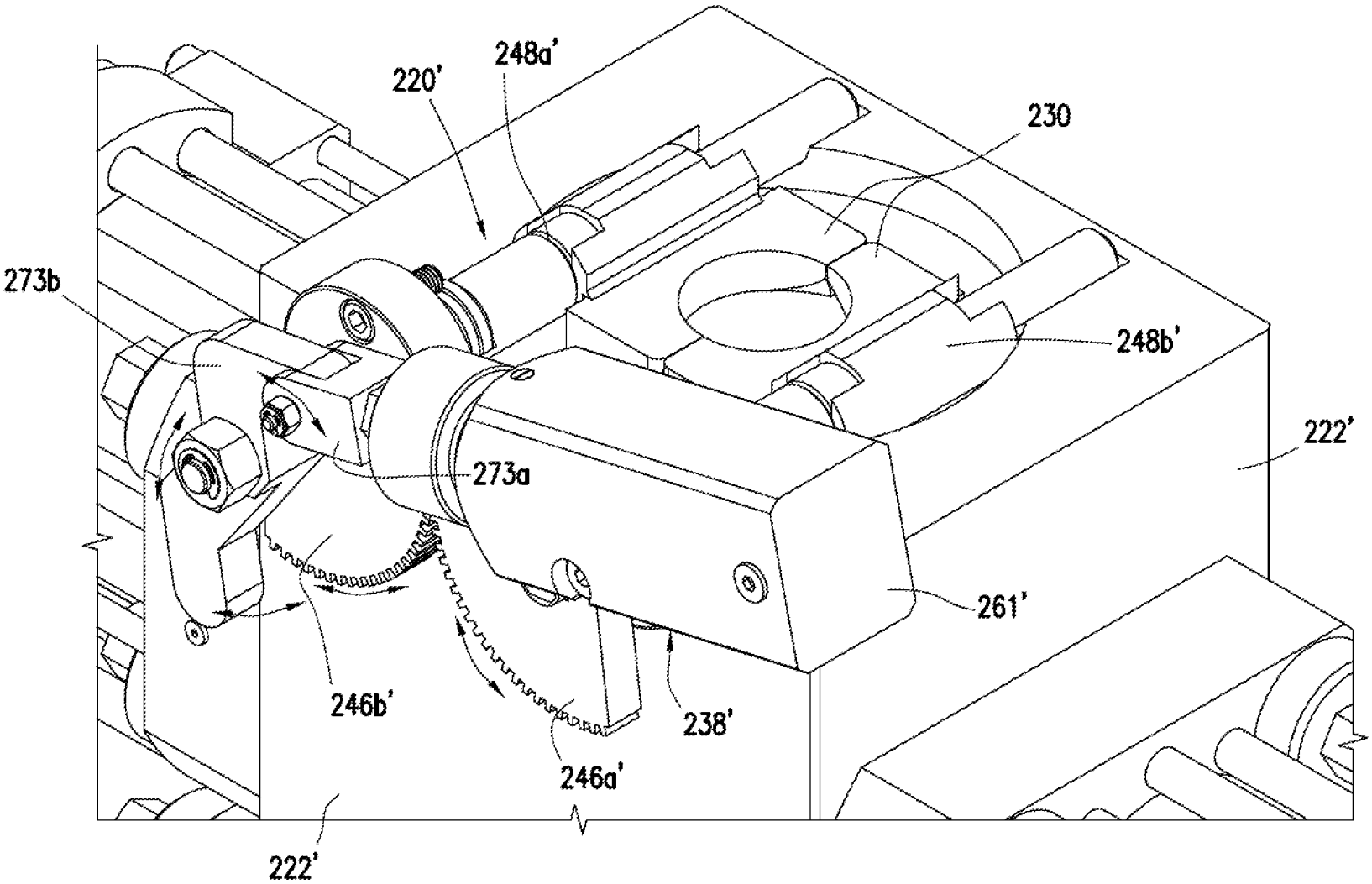

FIGS. 8 and 9A-9B show various views of another version of the BOP 212' with a gear-type guide assembly 220'. FIG. 10 shows an exploded view of the gear guide assembly 220'. In this version, the gear guide assembly 220' is integral with the BOP 212' and its BOP housing 222', and the gear driver 238' is external to the BOP housing 222'. As shown in FIGS. 9A-10, this version the gear driver 238' includes a first driver or actuator 250' to axially drive a second driver or translator 239'. The rods 248*a',b'* are rotationally driven by a translator 239' in the forms of interlocking gears 246*a',b'*. The actuator 250' including an axial piston 263' coupled to the gears 246*a',b'* by linkages 273*a,b* to transfer the axial motion of the axial piston 263' into rotary motion of the gears 246*a',b'*.

The actuator 250' in this version includes a cylinder 26 with a piston 263' coupled to the connectors 249*a',b'*. The piston 263' extends through a bushing 271 and is coupled to connectors 249*a'*. A spring 25 is provided about the piston 263' to urge the flappers 230 towards the closed position. Connectors 249*a'* include the linkages 273 *a,b*.

An end of the piston 263' is connected to a first linkage 273*a* for extension and retraction thereof. The first linkage 273*a* is pivotally connected to the second linkage 273*b*. The second linkage 273*b* rotates as the first linkage 273*a* is extended and retracted by the piston 263'. The second linkage 273*b* has a portion fixed to the housing 222', and a portion pivotal about the first linkage 273*a*. The second linkage 273*b* also has a hole 275*a* (in this example a rectangular hole) to receive an end of the rod 248*a'* to translate rotation thereto.

The rods 248*a',b'* are coupled to the connectors 249*a'* by connectors 249*b'* and the gears 246*a',b'*. The connectors 249*b'* include bushing 277*a* secured to the housing 222' by bolts 249, and keyed bushings 277*b* receivable in holes 275*b* in the gears 246*a'b*. The end of the rods 248*a', b'* extend through the bushings 277*a,b*, and the holes 275*b* in the gears 246*a',b'*. The ends of the rods 248*a',b'* are keyed to corresponding openings in the bushings 277*b* for rotation therewith. An outer surface of the bushings 277*b* is keyed to correlate with a shape of the openings 275*b* in the gears 246*a', b'* for rotation therewith.

The gears 246*a',b'* have toothed outer surfaces that interlock to translate rotation therebetween. In this manner, rotation from gear 246*a'* and the rod 248*a'* connected thereto is translated to the gear 246*b'* and the corresponding rod 248*b'* to rotate the flappers 230 connected thereto. The gears 246*a',b'* are shown as curved gears interlocked via the teeth to translate rotation therebetween.

As the piston 263' extends and retracts, linkage 273*a* is moved, and linkage 273*b* is rotated thereby. Rotation of linkage 273*b* is translated to gear 246*a'* and bushing 277*b*, which thereby rotates rod 248*a'* and its connected flapper 230. Rotation of gear 246*a'* is translated to the other gear 246*b'* and the bushing 277*b*, rod 248*b'*, and flappers 230 connected thereto. Thus, rotation of gear 246*a'* rotates the gear 246*b'* and the rod 248*b'* and flapper 230 connected thereto.

As demonstrated by FIGS. 3 A-10, the tool guide assembly may have various configurations effective to open and close the flappers to permit the downhole tool and/or tubing to pass into the wellbore and to provide guiding thereof. Additional variations of the tool guide assembly are provided herein.

FIG. 11 is a flow chart depicting a method 1100 of guiding a downhole tool into a wellbore. The method 1100 involves 1180—positioning a tool guide assembly about the wellbore with a passage of the tool guide assembly in fluid communication with the wellbore. The tool guide assembly comprising flappers and a driver (e.g., cam driver), and the driver comprises a movable plate operatively connectable to the flappers via cams (see, e.g., FIGS. 2A-7).

The method also involves 1182—movably positioning the flappers about the passage to selectively reduce an inlet to the passage. The reduced inlet is smaller than the passage, smaller than the downhole tool, and larger than the tubing. The movably positioning may involve selectively opening the flappers to receive a downhole tool into the passage, and/or closing the flappers about a tubing after the downhole tool is deployed through the inlet via the tubing.

The method also involves 1184—controlling passage into the wellbore by driving the flappers. The driving may be performed, for example, by a cam (or gear, rotary, and/or other translator) moved by axial and/or rotary actuators. The driving may involve, for example, axially driving a movable plate to rotationally drive the flappers via the cams. This driving may involve advancing a piston to axially drive the movable plate and/or controlling operation of a blowout preventer. The driving may also involve rotationally driving gears to rotationally drive the flappers. The rotationally driving may involve rotating the flappers by rotating the rods with an axial piston or a rotary actuator.

The method may also involve other operations, such as 1186—centering the tubing by guiding the tubing with the flappers, 1188—retracting the downhole tool from the passage through the inlet, 1190—opening the flappers with the downhole tool by pushing the downhole tool against the flappers during the retracting, 1192—preventing the downhole tool from passing into the bore by urging the flappers to a closed position, and/or 1194—supporting the downhole tool on the flappers when in the flappers are in a closed position.

The method(s) and/or portions thereof may be performed in any order, and repeated as desired.

FIGS. 12-16 show various views of another version of the BOP 212" with a rotary-type guide assembly 220". FIG. 12 shows a perspective view of an example BOP 212" with the rotary guide assembly 220". FIGS. 13A-13B show a portion of the BOP 212" with the rotary guide assembly 220" in an open and closed position, respectively. FIGS. 14A-16 shows side, perspective, cross-sectional, and exploded views, respectively, of the rotary guide assembly 220".

As shown in FIGS. 14A-16, the rotary guide assembly 220" includes a driver 238" in the form of a rotary driver. The rotary driver 238" includes a translator in the form of a gearbox 239" and an actuator in the form of a rotary actuator 250". The actuator 250" is rotationally coupled to a first end of the rod 248*a*" by connectors 249*a*" (e.g., bolts, bushings, and/or brackets). The actuator 250" rotates the rod 248*a*". The rotary actuator 250" may be any device capable of rotationally driving the rod 248*a*'. Examples of rotary actuators may include Parker Hub Series Unibody Rotary Actuators, commercially available from PARKER HANNIFIN CORP.™ at www.parker.com.

The rods 248*a*", b" extend through the hinges 242 of the flappers 230 for connection to the gear box 239". The rods 248*a",b*" may be keyed to the flappers 230 for rotation therewith as described herein. A first end of the other rod 248*b*" is positioned against a wall of the BOP. A second end of the rods 248*a",b*" are coupled to the gearbox 239". The rods 248*a", b*" may be coupled to the gearbox 239" by a connection 249*b*". In this version, the connection 249*b*" includes a bonnet 299 with connector bars 260, spacers 292, and bushings 297. Other devices may also be provided to rotationally support the rods about the translator 238" and the flappers 230, such as seals, bushings, and retainers as shown, and/or other devices.

The translator 238" is shown as a gearbox 239" with gears 246*a",b*" therein. The gears 246*a",b*" are supported in the gearbox 239" and are rotationally interconnected by interlocking teeth in a manner similar to the gears 246*a",b*" of the gear guide assembly 220". Examples of gears and/or gearboxes that may use are provided by Parallel Shaft Drive Gearbox, commercially available from HUB CITY INC.™ at www.hubcityinc.com.

In this version, the rods 248*a",b*" each extend through one of the gears 246*a",b*" and are coupled thereto for rotation therewith. The gears 246*a",b*" are coupled to the rods 248*a",b*" such that rotation of the rod 248*a*" by the rotary actuator 250" and rotates gear 246*a*", which rotates gear 248*b*" via the interlocking teeth to rotate gear 248*b*", which rotates rod 248*b*" connected to gear 248*b*". The rotation of the rods 248*a*", b" rotates the flaps 230, thereby opening and closing the flaps 230.

FIG. 17 is a flow chart depicting a method 1700 of guiding a downhole tool into a wellbore. The method 1700 involves 1780—positioning a tool guide assembly about the wellbore with a passage of the tool guide assembly in fluid communication with the wellbore, 1786—centering the tubing by guiding the tubing with the flappers, 1782—movably positioning the flappers about the passage to selectively reduce an inlet to the passage, 1788—retracting the downhole tool from the passage through the inlet, 1790—opening the flappers with the downhole tool by pushing the downhole tool against the flappers during the retracting, 1792—preventing the downhole tool from passing into the bore by urging the flappers to a closed position, and/or 1794—supporting the downhole tool on the flappers when in the flappers are in a closed position as previously described in FIG. 11.

In this version, the method also involves 1784—selectively permitting passage of the downhole tool through the passage by selectively moving the flappers between a closed position and an open position to define a variable inlet to the passage. The variable inlet has a diameter smaller than a diameter of the downhole tool when in the closed position and a diameter larger than the diameter of the downhole tool when in the open position. The selectively permitting may involve closing the flappers about a tubing after the downhole tool is deployed through the inlet via the tubing, rotating the flappers, and/or using rotary and/or axial motion to rotate the flappers.

The method(s) and/or portions thereof may be performed in any order, and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the subject matter may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more features of the BOP and/or tool guide assembly may be provided.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A guide assembly for a downhole tool, comprising:

a guide housing having a passage to receive the downhole tool therethrough;

flappers movably supported about the passage by rods, wherein the flappers are movable between a closed position and an open position to selectively define a variable inlet to the passage, the variable inlet being smaller than the passage when the flappers are in the closed position; and a driver comprising a translator rotationally coupled to the flappers via the rods and an actuator to rotate the translator, the flappers rotatable between the closed and the open position by the driver whereby passage of the downhole tool into the passage is selectively permitted;

wherein each flapper comprises a receiving portion including a concave recess configured to receive a tubular coupled to the downhole tool and a pair of ends positioned on opposite sides of the concave recess;

wherein the pair of ends of each flapper matingly engage the pair of ends of another flapper when the flappers are in the closed position;

wherein the concave recesses of the flappers define the variable inlet.

2. The guide assembly of claim 1, wherein the actuator is one of an axial and rotary actuator.

3. The guide assembly of claim 1, wherein the translator comprises a stationary plate and a movable plate, the movable plate axially movable about the stationary plate by the actuator, and cams rotatable by the movable plate, the flappers connected to the cams by the rods for rotation therewith.

4. The guide assembly of claim 3, further comprising linear guides linearly supporting the movable plate about the fixed plate.

5. The guide assembly of claim 3, wherein the actuator comprises a piston and cylinder, the piston positioned adjacent the rod to translate axial movement thereto.

6. The guide assembly of claim 1, wherein the translator comprises interlocking gears connected to the flappers by the rods to translate rotation therebetween.

7. The guide assembly of claim 6, wherein the actuator comprises an axial piston rotationally coupled to the interlocking gears by linkages.

8. The guide assembly of claim 6, wherein each of the interlocking gears is coupled to one of the flappers via the rods.

9. The guide assembly of claim 6, wherein the actuator comprises a rotary actuator rotationally coupled to a first end of one of the rods, the actuator rotationally coupled to the interlocking gears via the one of the rods.

10. The guide assembly of claim 1, wherein the variable inlet has a diameter smaller than a diameter of the downhole tool when the flappers are in the closed position.

11. The guide assembly of claim 1, wherein the flappers are rotatably coupled to the guide housing, and wherein the flappers are configured to rotate downward to the closed position and rotate upward to the open position.

12. The guide assembly of claim 11, wherein the flappers are biased to the closed position.

13. A blowout preventer, comprising:

a blowout preventer housing having a passage to receive a downhole tool therethrough;

at least one ram movably positionable about the passage to selectively seal the passage;

and a guide assembly positioned about the blowout preventer housing, the guide assembly comprising:

flappers movably supported about the passage by rods, wherein the flappers are movable between a closed position and an open position to selectively define a variable inlet to the passage, the variable inlet being smaller than the passage when the flappers are in the closed position; and a driver comprising a translator rotationally coupled to the flappers via the rods and an actuator to rotate the translator, the flappers rotatable between the closed and the open position by the driver whereby passage of the downhole tool into the passage is selectively permitted;

wherein each flapper comprises a receiving portion including a concave recess configured to receive a tubular coupled to the downhole tool and a pair of ends positioned on opposite sides of the concave recess;

wherein the pair of ends of each flapper matingly engage the pair of ends of another flapper when the flappers are in the closed position;

wherein the concave recesses of the flappers define the variable inlet.

14. The blowout preventer of claim 13, wherein the guide assembly is one of integral with and connected to the blowout preventer housing.

15. The blowout preventer of claim 13, wherein the actuator is coupled to the at least one ram for actuating the at least one ram.

16. A method of guiding a downhole tool into a wellbore, comprising:

connecting a guide assembly to a blowout preventer and positioning the guide assembly about the wellbore, wherein the guide assembly has a passage in fluid communication with the wellbore, and wherein the guide assembly comprising comprises flappers movably supported about the passage, wherein each flapper comprises a receiving portion including a concave recess configured to receive a tubular coupled to the downhole tool and a pair of ends positioned on opposite sides of the concave recess;

and selectively permitting passage of the downhole tool through the passage by selectively driving the flappers between a closed position and an open position to define a variable inlet to the passage, wherein the variable inlet has a diameter smaller than a diameter of the downhole tool when in the closed position and a diameter larger than the diameter of the downhole tool when in the open position, wherein the concave recesses of the flappers define the variable inlet to the passage, and wherein the pair of ends of each flapper matingly engage the pair of ends of another flapper when the flappers are in the closed position.

17. The method of claim 16, wherein the selectively permitting comprises at least one of closing the flappers about a tubing after the downhole tool is deployed through the inlet via the tubing, rotating the flappers, and using axial motion to rotate the flappers.

18. The method of claim 16, further comprising retracting the downhole tool from the passage through the inlet.

19. The method of claim 18, further comprising opening the flappers with the downhole tool by pushing the downhole tool against the flappers during the retracting.

20. The method of claim 16, further comprising preventing the downhole tool from passing into the passage by urging the flappers to the closed position.

21. The method of claim 16, further comprising supporting the downhole tool on the flappers when the flappers are in a closed position.

22. The method of claim 16, wherein selectively driving the flappers between a closed position and an open position comprises rotating the flappers.

23. The method of claim 22, further comprising biasing the flappers to the closed position.

* * * * *